US011525334B2

(12) United States Patent
Kalantari et al.

(10) Patent No.: US 11,525,334 B2
(45) Date of Patent: Dec. 13, 2022

(54) METHOD OF OPTIMIZING OPERATION ONE OR MORE TUBING STRINGS IN A HYDROCARBON WELL, APPARATUS AND SYSTEM FOR SAME

(71) Applicant: NCS MULTISTAGE INC., Calgary (CA)

(72) Inventors: Masoud Kalantari, Calgary (CA); Timothy Johnson, Calgary (CA); Warren MacPhail, Calgary (CA); Lyle Laun, Calgary (CA); John Ravensbergen, Calgary (CA); Siamak Arbatani, Calgary (CA)

(73) Assignee: NCS MULTISTAGE INC.

( * ) Notice: Subject to any disclaimer, the term of this patent is extended or adjusted under 35 U.S.C. 154(b) by 56 days.

(21) Appl. No.: 16/964,619

(22) PCT Filed: Jan. 30, 2019

(86) PCT No.: PCT/CA2019/050117
§ 371 (c)(1),
(2) Date: Jul. 24, 2020

(87) PCT Pub. No.: WO2019/148279
PCT Pub. Date: Aug. 8, 2019

(65) Prior Publication Data

US 2020/0370397 A1 Nov. 26, 2020

Related U.S. Application Data

(60) Provisional application No. 62/624,079, filed on Jan. 30, 2018.

(51) Int. Cl.
*E21B 34/16* (2006.01)
*E21B 43/12* (2006.01)
(Continued)

(52) U.S. Cl.
CPC ..... *E21B 34/16* (2013.01); *E21B 34/08* (2013.01); *E21B 43/12* (2013.01); *E21B 43/14* (2013.01);
(Continued)

(58) Field of Classification Search
CPC ..... E21B 34/16; E21B 34/08; E21B 43/12; E21B 43/14; E21B 43/162; E21B 47/06
See application file for complete search history.

(56) References Cited

U.S. PATENT DOCUMENTS 2,280,788 A 4/1942 Boynton
4,295,795 A 10/1981 Gass et al.
(Continued)

FOREIGN PATENT DOCUMENTS

CA 2948273 A1 5/2017
WO 2001065056 A1 9/2001
WO 2016181154 A1 11/2016

OTHER PUBLICATIONS

International Search Report for PCT/CA2019/050107, dated Apr. 23, 2019.
(Continued)

*Primary Examiner* — Catherine Loikith
(74) *Attorney, Agent, or Firm* — Nolte Lackenbach Siegel

(57) ABSTRACT

A method, system and apparatus of optimizing operation of one or more tubing strings in a hydrocarbon well are provided. Each tubing string is located in a hydrocarbon well and has a plurality of valves. Each valve is actuatable between a fully open position and a fully closed position and is in communication with a respective zone of a formation defining a reservoir containing hydrocarbon material. The method includes characterizing an injectivity of one or more zones of the formation and determining an optimal operating schedule in accordance with the characterization. The optimal operating schedule comprises one or more valve configurations and an operating duration for each of the one or more valve configurations.

23 Claims, 13 Drawing Sheets

(51) Int. Cl.

| | |
|---|---|
| ***E21B 43/14*** | (2006.01) |
| ***E21B 43/16*** | (2006.01) |
| ***E21B 47/06*** | (2012.01) |
| ***E21B 34/08*** | (2006.01) |

(52) U.S. Cl.
CPC ..... *E21B 43/16* (2013.01); *E21B 43/162* (2013.01); *E21B 47/06* (2013.01)

(56) References Cited

U.S. PATENT DOCUMENTS

| | | | | |
|---|---|---|---|---|
| 4,432,416 | A | 2/1984 | Welch et al. | |
| 5,937,945 | A | 8/1999 | Bussear et al. | |
| 6,000,468 | A | 12/1999 | Pringle | |
| 6,715,550 | B2 | 4/2004 | Vinegar et al. | |
| 6,957,577 | B1 | 10/2005 | Firmin | |
| 7,086,464 | B2 * | 8/2006 | Edwards | E21B 34/066 166/250.1 |
| 7,234,524 | B2 * | 6/2007 | Shaw | E21B 41/02 166/368 |
| 9,200,799 | B2 * | 12/2015 | O'Donnell | F24S 60/30 |
| 9,453,389 | B2 | 9/2016 | Anderson et al. | |
| 10,323,481 | B2 | 6/2019 | Pratt et al. | |
| 2015/0034323 | A1 | 2/2015 | Greene et al. | |
| 2015/0369023 | A1 | 12/2015 | MacPhail et al. | |
| 2017/0130557 | A1 | 5/2017 | Pratt et al. | |
| 2019/0257173 | A1 | 8/2019 | Pratt et al. | |

OTHER PUBLICATIONS

International Search Report for PCT/CA2019/050117, dated Apr. 25, 2019.

* cited by examiner

METHOD OF OPTIMIZING OPERATION ONE OR MORE TUBING STRINGS IN A HYDROCARBON WELL, APPARATUS AND SYSTEM FOR SAME

CROSS-REFERENCE TO RELATED APPLICATIONS

This Application is a 371 Application of International Patent Application Serial No. PCT/CA2019/050117, entitled, "METHOD OF OPTIMIZING OPERATION ONE OR MORE TUBING STRINGS IN A HYDROCARBON WELL, APPARATUS AND SYSTEM FOR SAME, filed Jan. 30, 2019, which claims priority to, and the benefit of, provisional U.S. Ser. Patent Application No. 62/624,079, filed Jan. 30, 2018.

RELATED APPLICATION DATA

The present disclosure claims priority to, and the benefit of, provisional U.S. patent application No. 62/624,079, filed Jan. 30, 2018, the content of which is incorporated herein by reference.

TECHNICAL FIELD

The present disclosure relates to hydrocarbon wells, and in particular, to methods of optimizing operation of a tubing string in a hydrocarbon well and methods of operating a hydrocarbon well, an apparatus and system for same.

BACKGROUND

The control of hydrocarbon production is a challenging problem, particularly with regard to hydrocarbon wells used in a displacement process, such as secondary recovery or enhanced oil recovery (EOR) schemes, in which hydrocarbon production is assisted by injection of a fluid. A hydrocarbon well may comprise a number of flow communication stations, such as valves, that control the input of an injection fluid to a hydrocarbon reservoir or output of produced hydrocarbon material. It may be difficult to operate the hydrocarbon well so that one or more operating parameters or objectives are achieved.

SUMMARY

The present disclosure provides methods of optimizing operation of one or more tubing strings located in a hydrocarbon well, methods of operating a hydrocarbon well, an apparatus and system for same. In some embodiments, downhole pressure sensors located in the tubing string are used to measure the pressure of an injection fluid, production fluid or formation/reservoir fluid at the location of each valve in a tubing string. The pressure measurements can be used to determine flow rates without a downhole flowmeter, which is too large to be located downhole in most tubing strings. The flow rates, or volumes determined from flow rates over time, can be used to optimize via optimization algorithms a valve configuration of the tubing strings and/or operation of the tubing strings, for example, by determining an operating schedule for the tubing string in accordance with one or more performance objectives. The flow rates, or volumes determined from flow rates over time, can also be used to characterize the injectivity of a formation/reservoir or to characterize the production from a formation/reservoir. The determined characterizations can also be used to optimize a valve configuration of the tubing strings and/or operation of the tubing strings, for example, by determining an operating schedule for the tubing string in accordance with one or more performance objectives. Surface pressure measurements can be used instead of, or in addition to, downhole pressure measurements if desired.

In accordance with one aspect of the present disclosure, there is provided a method, performed by a processor of at least one apparatus, of optimizing operation of one or more tubing strings, each tubing string being located in a hydrocarbon well and having a plurality of valves, each valve being actuatable between a fully open position and a fully closed position, each valve being in communication with a respective zone of a formation defining a reservoir containing hydrocarbon material, the method comprising: for each injection string in the one or more tubing strings: (i) characterizing an injectivity of one or more zones of the formation in accordance with sensed characteristics of an injection fluid; (ii) determining an optimal operating schedule for the injection string in accordance with the characterization of the one or more zones of the formation and one or more performance objectives of the respective injection string, wherein the optimal operating schedule comprises one or more valve configurations and an operating duration for each of the one or more valve configurations, wherein each valve configuration is defined by a condition of the valves in which each valve in the plurality of valves is in either the fully open position or the fully closed position.

In some examples, the method further comprises: (iii) causing a condition of the valves to be set in accordance with the optimal operating schedule for the injection string.

In some examples, the method further comprises: (iv) causing injection of the injection fluid into the injection string in accordance with the optimal operating schedule for the injection string; (v) monitoring to detect one or more triggers for re-optimizing the optimal operating schedule for the injection string; (vi) repeating steps (i) to (iii) in response to detection of a trigger for re-optimizing the optimal operating schedule for the injection string.

In some examples, the apparatus is a remote server in communication with a controller, wherein the controller is coupled to the valves and controls a valve condition of each of the valves, wherein characterizing the injectivity and determining the optimal operating schedule is performed by the server and causing the condition of the valves to be set in accordance with the optimal operating schedule is performed by the controller, wherein the causing the condition of the valves to be set in accordance with the optimal operating schedule comprises sending an instruction to the controller to set the condition of the valves in accordance with the optimal operating schedule.

In some examples, determining the optimal operating schedule comprises: generating a simulation of fluid flow within a simulation of the formation for each of the valve configurations; and determining the one or more valve configurations and the operating duration for each of the one or more valve configurations which optimizes the one or more performance objectives.

In some examples, generating the simulation of fluid flow within the simulation of the formation for each of the valve configurations comprises: generating the simulation of the formation using the characterization of the one or more zones of the formation; generating the simulation of fluid flow within the simulation of the formation for each of the valve configurations.

In some examples, the one or more performance objectives comprise one or more of evenly distributing the flow of the injection fluid through one or more valves in the plurality of valves, maximizing the flow of the injection fluid through one or more valves in the plurality of valves, maximizing an accumulated volume of injection fluid injected through one or more valves, maintaining a pressure of the injection fluid at surface at a desired value, minimizing changes in valve condition, isolating the flow of the injection fluid through one or more valves, distributing the flow of the injection fluid through one or more valves by predetermined differing amounts, and/or receiving the injection fluid through one or more valves in response to back pressure or under pressure from a surface pump.

In some examples, the one or more performance objectives comprise one or more of evenly distributing the flow of the injection fluid and maximizing the flow of the injection fluid through the valves.

In some examples, characterizing the injectivity of one or more zones of the formation comprises: for each of a set of valve configurations: causing a condition of the valves to be set in accordance with the valve configuration; causing supplying of the injection fluid to the formation through the injection string; sensing one or more characteristics of the injection fluid at a location of one or more valves corresponding to the one or more zones of the formation to be characterized; causing supplying of the injection fluid to the formation through the injection string to be suspended; continuing to sense the one or more characteristics of the injection fluid after suspending the supply of injection fluid to the formation until a termination condition is detected; and characterizing the one or more zones of the formation in accordance with changes in the sensed one or more characteristics of the injection fluid over time.

In some examples, the one or more sensed characteristics of the injection fluid comprises a pressure of the injection fluid.

In some examples, characterizing the injectivity of one or more zones of the formation comprises: for each of a set of valve configurations: causing a condition of the valves to be set in accordance with the valve configuration; causing supplying of the injection fluid to the formation through the injection string; sensing one or more characteristics of the injection fluid; causing supplying of the injection fluid to the formation through the injection string to be suspended; continuing to sense the one or more characteristics of the injection fluid after suspending the supply of injection fluid to the formation until a termination condition is detected; determining a pressure of the injection fluid at the location of the one or more valves corresponding to the one or more zones of the formation to be characterized; and characterizing the one or more zones of the formation in accordance with changes in the determined pressure of the injection fluid over time.

In some examples, the pressure of the injection fluid is sensed by a pressure sensor of the one or more valves.

In some examples, the pressure of the injection fluid is sensed by a pressure sensor located within, or within a proximity of, the one or more valves.

In some examples, each pressure sensor measures a pressure of a zone of the formation in communication with the respective valve.

In some examples, the pressure of the injection fluid is sensed by a pressure sensor located uphole of the valves.

In some examples, the pressure of the injection fluid is sensed by a pressure sensor located at the surface.

In some examples, the characterizing is based on an accumulated volume of the injection fluid determined from the one or more sensed characteristics of the injection fluid.

In some examples, while characterizing the injectivity of the one or more zones of the formation only one valve is open at a time, wherein when one valve is open the other valves in the plurality of valves are closed.

In some examples, characterizing the injectivity of the one or more zones of the formation is performed when the one or more zones of the formation are substantially free of voidage.

In some examples, characterizing the injectivity of the one or more zones of the formation is performed after the one or more zones of the formation are substantially charged with injection fluid.

In some examples, characterizing the injectivity of one or more zones of the formation comprises: calculating a flow coefficient for each of the one or more zones of the formation in accordance with changes in a pressure or a flow rate of the injection fluid associated with the respective zone of the formation after suspending the supply of injection fluid to the formation through the injection string.

In some examples, determining the optimal operating schedule comprises: calculating the flow rate for each of the one or more zones of the formation using the respective flow coefficient.

In some examples, the injection fluid is a liquid.

In some examples, the injection fluid is a gas.

In some examples, characterizing the injectivity of one or more zones of the formation comprises: for each valve in the injection string: opening the valve while other valves in the injection string are kept closed; causing supplying of the injection fluid to the formation through the valve; sensing a pressure of the injection fluid; causing supplying of the injection fluid to the formation through the injection string to be suspended; continuing to sense the pressure of the injection fluid after suspending the supply of injection fluid to the formation through the injection string until a termination condition is detected; and characterizing a zone of the formation in communication with the valve in accordance with changes in the sensed pressure of the injection fluid over time.

In some examples, characterizing the injectivity of one or more zones of the formation comprises: for each of a set of valve configurations: causing a condition of the valves to be set in accordance with the valve configuration; causing supplying of the injection fluid to the formation through the injection string; causing a flow rate of the injection fluid from zero to a maximum flow rate; sensing a pressure of the injection fluid during the varying of the flow rate of the injection fluid; and determining a mapping of flow rate to pressure.

In some examples, the pressure of the injection fluid is sensed by a pressure sensor of the one or more valves.

In some examples, the pressure of the injection fluid is sensed by a pressure sensor located within, or within a proximity of, the one or more valves.

In some examples, each pressure sensor measures a pressure of a zone of the formation in communication with the respective valve.

In some examples, the pressure of the injection fluid is sensed by a pressure sensor located uphole of the valves.

In some examples, the pressure of the injection fluid is sensed by a pressure sensor located at the surface.

In some examples, the method is performed for multiple tubing strings located in the formation, wherein each tubing string interacts with a common hydrocarbon reservoir well, wherein the method is performed for multiple tubing strings to jointly optimize the operation of the multiple tubing strings.

In some examples, the operation of the multiple tubing strings is jointly optimized based on the characterizations of the one or more zones of the formation in communication with each of the multiple tubing strings and the one or more performance objectives of each of the multiple tubing strings.

In some examples, the method further comprises: for each production string in the one or more tubing strings: (i) characterizing a production flow of one or more zones of the formation in accordance with sensed characteristics of a production fluid; and (ii) determining an optimal operating schedule for the production string in accordance with the characterization of the production flow and/or one or more zones of the formation and one or more performance objectives of the respective production string.

In some examples, the method further comprise: for each production string in the one or more tubing strings: (iii) causing a condition of the valves of the production string to be set in accordance with the optimal operating schedule for the production string.

In some examples, the one or more sensed characteristics of the production flow comprise one or more of a pressure of the production fluid, an accumulated volume of the production fluid, hydrocarbon content of the production fluid, water content of the production fluid, and gas content of the production fluid.

In some examples, the one or more performance objectives of the respective production string comprise minimizing the water content of the the production fluid, wherein the optimal operating schedule is configured to exclude valve configurations in which valves in communication with zones that produce substantially only water are open.

In some examples, the characterizing is based on an accumulated volume of the production fluid determined from the one or more sensed characteristics of the production fluid.

In some examples, the method is performed for multiple tubing strings located in the formation, wherein each tubing string interacts with a common hydrocarbon reservoir well, wherein the method is performed for multiple tubing strings to jointly optimize the operation of the multiple tubing strings.

In some examples, the operation of the multiple tubing strings is jointly optimized based on the characterizations of the one or more zones of the formation in communication with each of the multiple tubing strings and the one or more performance objectives of each of the multiple tubing strings, wherein the multiple tubing strings comprise injection strings, production strings, or a combination thereof.

In some examples, the method further comprises: (iv) causing production of a production fluid from the formation through the production string in accordance with the optimal operating schedule for the production string; (v) monitoring the production fluid to detect one or more triggers for re-optimizing with the optimal operating schedule for the production string; (vi) repeating steps (i) to (iii) in response to detection of a trigger for re-optimizing with the optimal operating schedule for the production string.

In some examples, causing production of the production fluid from the production string comprises: causing supplying of the injection fluid to a nearby injection string.

In some examples, characterizing the production flow of one or more zones of the formation comprises: for each of a set of valve configurations: causing a condition of the valves to be set in accordance with the valve configuration; causing production of the production fluid from the production string; sensing one or more characteristics of the production fluid; causing production of the production fluid from the production string to be suspended; continuing to sense the one or more characteristics of the production fluid after suspending the production of the production fluid from the valve until a termination condition is detected; and characterizing the one or more zones of the formation in accordance with changes in the sensed one or more characteristics of the production fluid over time.

In some examples, the one or more sensed characteristics of the production fluid comprises a pressure of the production fluid.

In some examples, the pressure of the production fluid is sensed by a pressure sensor of the one or more valves.

In some examples, the pressure of the production fluid is sensed by a pressure sensor located within, or within a proximity of, the one or more valves.

In some examples, each pressure sensor measures a pressure of a zone of the formation in communication with the respective valve.

In some examples, the pressure of the production fluid is sensed by a pressure sensor located uphole of the valves.

In some examples, the pressure of the production fluid is sensed by a pressure sensor located at the surface.

In some examples, the injection string and production string are located in the same well, wherein the injection string and production string are alternatively operated to provide cyclical injection and production from the same well.

In some examples, the injection string and production string are located in different wells within proximity of each other, which the injection of the injection fluid into the injection string stimulates production in the production string.

In accordance with another aspect of the present disclosure, there is provided a method, performed by a processor of at least one apparatus, of optimizing operation of one or more tubing strings, each tubing string being located in a hydrocarbon well and having a plurality of valves, each valve being actuatable between a fully open position and a fully closed position, each valve being in communication with a respective zone of a formation defining a reservoir containing hydrocarbon material, the method comprising: for each production string in the one or more tubing strings: (i) characterizing a production flow of one or more zones of the formation in accordance with sensed characteristics of a production fluid; and (ii) determining an optimal operating schedule for the production string in accordance with the characterization of the production flow and/or one or more zones of the formation and one or more performance objectives, wherein the optimal operating schedule comprises one or more valve configurations and an operating duration for each of the one or more valve configurations, wherein each valve configuration is defined by a condition of the valves in which each valve in the plurality of valves is in either the fully open position or the fully closed position.

In some examples, the method further comprises: (iii) causing, a condition of the valves of the production string to be set in accordance with the optimal operating schedule for the production string.

In some examples, the method further comprises: (iv) causing production of the production fluid from the production string in accordance with the optimal operating schedule for the production string; (v) monitoring to detect one or more triggers for re-optimizing with the optimal operating schedule for the production string; (vi) repeating steps (i) to (iii) in response to detection of a trigger for re-optimizing with the optimal operating schedule for the production string.

In some examples, causing production of the production fluid from the production string comprises: causing supplying of the injection fluid to a nearby injection string.

In some examples, characterizing the production flow of one or more zones of the formation comprises: for each of a set of valve configurations: causing a condition of the valves to be set in accordance with the valve configuration; causing production of the production fluid from the production string; sensing one or more characteristics of the production fluid; causing production of the production fluid from the production string to be suspended; continuing to sense the one or more characteristics of the production fluid after suspending the production of the production fluid from the valve until a termination condition is detected; and characterizing the one or more zones of the formation in accordance with changes in the sensed one or more characteristics of the production fluid over time.

In some examples, the one or more sensed characteristics of the production fluid comprises a pressure of the production fluid.

In some examples, the pressure of the production fluid is sensed by a pressure sensor of the one or more valves.

In some examples, the pressure of the production fluid is sensed by a pressure sensor located within, or within a proximity of, the one or more valves.

In some examples, each pressure sensor measures a pressure of a zone of the formation in communication with the respective valve.

In some examples, the pressure of the production fluid is sensed by a pressure sensor located uphole of the valves.

In some examples, the pressure of the production fluid is sensed by a pressure sensor located at the surface.

In some examples, the method is performed for multiple tubing strings located in the formation, wherein each tubing string interacts with a common hydrocarbon reservoir well, wherein the method is performed for multiple tubing strings to jointly optimize the operation of the multiple tubing strings.

In some examples, the operation of the multiple tubing strings is jointly optimized based on the characterizations of the one or more zones of the formation in communication with each of the multiple tubing strings and the one or more performance objectives of each of the multiple tubing strings.

In accordance with a further aspect of the present disclosure, there is provided a method, performed by a processor of at least one apparatus, of operating one or more tubing strings, each tubing string located in a hydrocarbon well and having a plurality of valves, each valve being actuatable between a fully open position and a fully closed position, each valve being in communication with a respective zone of a formation defining a reservoir containing hydrocarbon material, the method comprising: for each injection string in the one or more tubing strings: (i) causing a condition of the valves to be set in accordance with an operating schedule, wherein the operating schedule comprises one or more valve configurations and an operating duration for each of the one or more valve configurations, wherein each valve configuration is defined by a condition of the valves in which each valve in the plurality of valves is in either the fully open position or the fully closed position; (ii) causing injection of an injection fluid into the formation through the injection string in accordance with the operating schedule; (iii) monitoring to detect one or more triggers for optimizing the operating schedule; and (iv) repeating steps (i) to (iii) in response to detection of a trigger for optimizing operation of the operating schedule.

In accordance with a further aspect of the present disclosure, there is provided a method, performed by a processor of at least one apparatus, of operating one or more tubing strings, each tubing string located in a hydrocarbon well and having a plurality of valves, each valve being actuatable between a fully open position and a fully closed position, each valve being in communication with a respective zone of a formation defining a reservoir containing hydrocarbon material, the method comprising: for each production string in the one or more tubing strings: (i) causing a condition of the valves to be set in accordance with an operating schedule, wherein the operating schedule comprises one or more valve configurations and an operating duration for each of the one or more valve configurations, wherein each valve configuration is defined by a condition of the valves in which each valve in the plurality of valves is in either the fully open position or the fully closed position; (ii) causing production of a production fluid formation through the production string in accordance with the operating schedule; (iii) monitoring to detect one or more triggers for optimizing the operating schedule; and (iv) repeating steps (i) to (iii) in response to detection of a trigger for optimizing operation of the operating schedule.

In accordance with a further aspect of the present disclosure, there is provided a method, performed by a processor of at least one apparatus, of operating one or more tubing strings, each tubing string located in a hydrocarbon well and having a plurality of valves, each valve being actuatable between a fully open position and a fully closed position, each valve being in communication with a respective zone of a formation defining a reservoir containing hydrocarbon material, the method comprising: for each injection string in the one or more tubing strings: causing a condition of the valves to be set in accordance with a valve configuration, wherein the valve configuration is defined by a condition of the valves in which each valve in the plurality of valves is in either the fully open position or the fully closed position; causing injection of an injection fluid into the formation through the injection string; determining a pressure associated with a respective zone of the formation in communication with each open valve; calculating a flow rate at each open valve using a flow coefficient for a zone of the formation in communication with each open valve and the determined pressure of the injection fluid; determining whether the flow rates at each open valve achieve one or more performance objectives; and causing valve configuration to be changed in response to a determination that the flow rates at each open valve do not achieve the one or more performance objectives.

In accordance with a further aspect of the present disclosure, there is provided a method, performed by a processor of at least one apparatus, of operating one or more tubing strings, each tubing string located in a hydrocarbon well and having a plurality of valves, each valve being actuatable between a fully open position and a fully closed position, each valve being in communication with a respective zone of a formation defining a reservoir containing hydrocarbon material, the method comprising: for a production string in the one or more tubing strings: causing a condition of the valves to be set in accordance with a valve configuration, wherein the valve configuration is defined by a condition of the valves in which each valve in the plurality of valves is in either the fully open position or the fully closed position; causing production of a production fluid from the formation through production string; determining a pressure associated with a respective zone of the formation in communication with each open valve; calculating a flow rate at each open valve using a flow coefficient for a zone of the formation in communication with each open valve and the determined pressure of the production fluid; determining whether the flow rates at each open valve achieve one or more performance objectives; and causing the valve configuration to be changed in response to a determination that the flow rates at each open valve do not achieve the one or more performance objectives.

In accordance with a further aspect of the present disclosure, there is provided a method, performed by a processor of at least one apparatus, of optimizing operation of one or more tubing strings, each tubing string being located in a hydrocarbon well and having a plurality of valves, each valve being actuatable between a fully open position and a fully closed position, each valve being in communication with a respective zone of a formation defining a reservoir containing hydrocarbon material, the method comprising: for each of the one or more tubing strings: characterizing an injectivity of each zone of the formation in accordance with sensed characteristics of an injection fluid; determining an operating schedule for operating the one or more tubing strings in accordance with the characterization of the zones of the formation and one or more performance objectives, wherein the operating schedule comprises a valve configuration and an operating duration for performing cyclical injection and production, wherein each valve configuration is defined by a condition of the valves in which each valve in the plurality of valves is in either the fully open position or the fully closed position.

In some examples, performing cyclical injection and production comprises: alternating between injecting injection fluid into one or more zones one or more zones and producing production fluid from one or more zones one or more zones.

In some examples, injection and production are performed using different valves in the same or different tubing.

In some examples, injection is performed via an injection string and production is performed via a production string, wherein the injection string and production string are located in the same well.

In some examples, and production are performed using the same valves.

In accordance with a further aspect of the present disclosure, there is provided a method, performed by a processor of at least one apparatus, of optimizing operation of one or more tubing strings, each tubing string being located in a hydrocarbon well and having a plurality of valves, each valve being actuatable between a fully open position and a fully closed position, each valve being in communication with a respective zone of a formation defining a reservoir containing hydrocarbon material, the method comprising: characterizing an injectivity of one or more zones of the formation in accordance with sensed characteristics of an injection fluid; determining one or more sets of zones based on an injectivity type of the one or more zones of the formation, each set comprising one or more zones; determining a set of zones to receive a treatment based on the injectivity type; determining an injection fluid for treating the set of zones based on the injectivity type; determining an operating schedule for treating the set of zones, wherein the operating schedule comprises one or more valve configurations and an operating duration for each of the one or more valve configurations, wherein each valve configuration is defined by a condition of the valves in which each valve in the plurality of valves is in either the fully open position or the fully closed position, wherein one or more valve configurations of the operating schedule isolate the flow of the injection fluid through one or more valves associated with the set of zones to be treated; and causing, a condition of the valves to be set in accordance with the operating schedule.

In accordance with a further aspect of the present disclosure, there is provided a method, performed by a processor of at least one apparatus, of optimizing operation of one or more tubing strings, each tubing string being located in a hydrocarbon well and having a plurality of valves, each valve being actuatable between a fully open position and a fully closed position, each valve being in communication with a respective zone of a formation defining a reservoir containing hydrocarbon material, the method comprising: identifying communicating zones of a first well in which a first tubing string is located which cause production of a production fluid in a second well in which a second tubing string is located in response to injection of an injection fluid in an injection string located in the first well; identifying non-communicating zones of the first well which do not cause production of a production fluid in a second well in response to injection of an injection fluid in an injection string located in the first well; and determining an operating schedule for operating the first and second tubing strings, wherein the operating schedule comprises a first valve configuration and a first operating duration for performing injection into the communication zones of the first well, and a second valve configuration and a second operating duration for performing cyclical injection and production on the non-communicating zones of the first well, wherein each valve configuration is defined by a condition of the valves in which each valve in the plurality of valves is in either the fully open position or the fully closed position.

In some examples, the method further comprises: alternating between injecting into the communication zones of the first well and performing cyclical injection and production on the non-communicating zones of the first well in accordance with the operating schedule.

In some examples, the method further comprises: determining when a non-communicating zone of the first well becomes a communicating zone; and determining a new operating schedule for operating the first and second tubing strings in response to a determination that a non-communicating zone of the first well has become a communicating zone.

In accordance with a further aspect of the present disclosure, there is provided an apparatus comprising at least one processor and a memory coupled to the at least one processor. The memory may have tangibly stored thereon executable instructions that, when executed by the at least one processor, cause the apparatus to perform at least parts of one or more methods described herein. The apparatus may be an onsite controller, such as a programmable logic controller, or an application server that communicates with an onsite controller.

In accordance with yet further aspects of the present disclosure, there is provided a non-transitory machine readable medium having tangibly stored thereon executable instructions for execution by at least one processor of an apparatus, wherein the executable instructions, when executed by the at least one processor, cause the processor to perform at least parts of the methods described herein. The apparatus may be an onsite controller, such as a programmable logic controller, or an application server that communicates with an onsite controller.

DESCRIPTION OF EXAMPLE EMBODIMENTS

Figure 1:
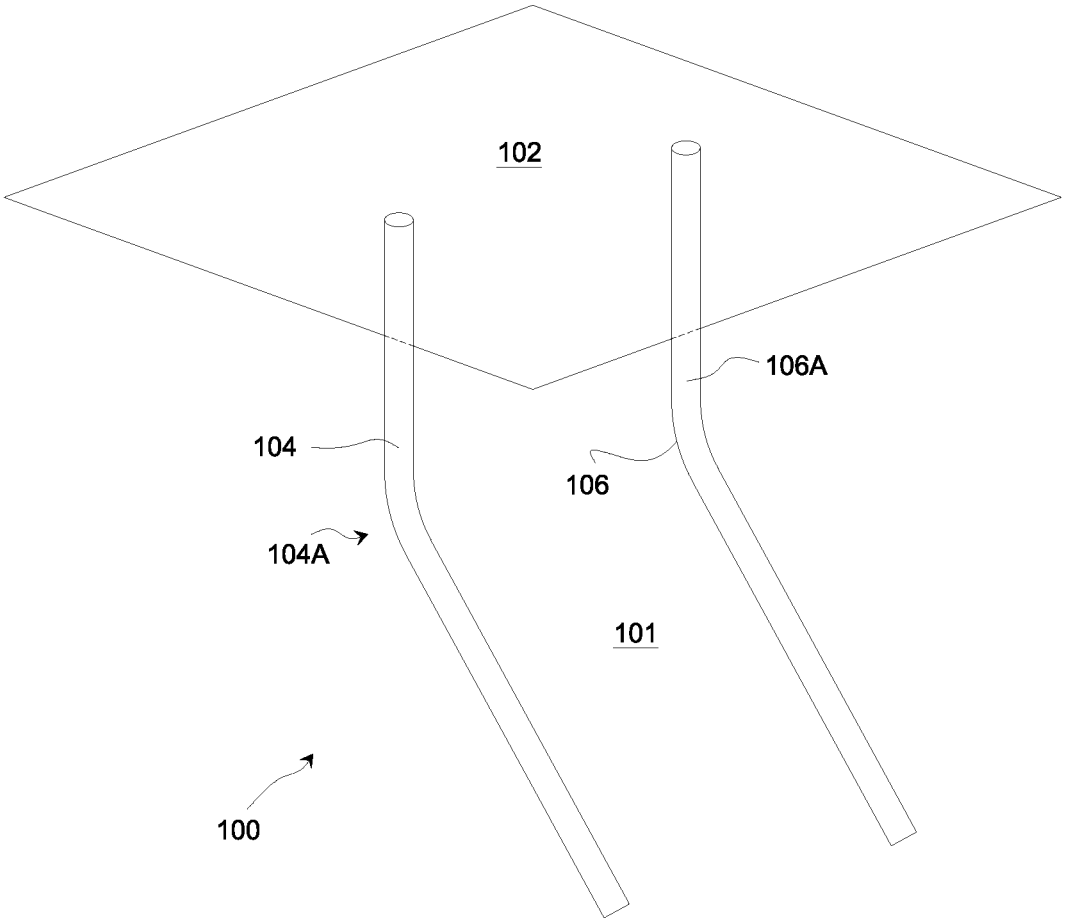
FIG. 1 is a schematic diagram of a first example apparatus with which example embodiments of the present disclosure may be applied.

The present disclosure is made with reference to the accompanying drawings, in which embodiments are shown. However, many different embodiments may be used, and thus the description should not be construed as limited to the embodiments set forth herein. Rather, these embodiments are provided so that this disclosure will be thorough and complete. Wherever possible, the same reference numbers are used in the drawings and the following description to refer to the same elements, and prime notation is used to indicate similar elements, operations or steps in alternative embodiments. Separate boxes or illustrated separation of functional elements of illustrated systems and devices does not necessarily require physical separation of such functions, as communication between such elements may occur by way of messaging, function calls, shared memory space, and so on, without any such physical separation. As such, functions need not be implemented in physically or logically separated platforms, although they are illustrated separately for ease of explanation herein. Different devices may have different designs, such that although some devices implement some functions in fixed function hardware, other devices may implement such functions in a programmable processor with code obtained from a machine-readable medium. Lastly, elements referred to in the singular may be plural and vice versa, except where indicated otherwise either explicitly or inherently by context.

System for Operating Hydrocarbon Wells

Figure 6:
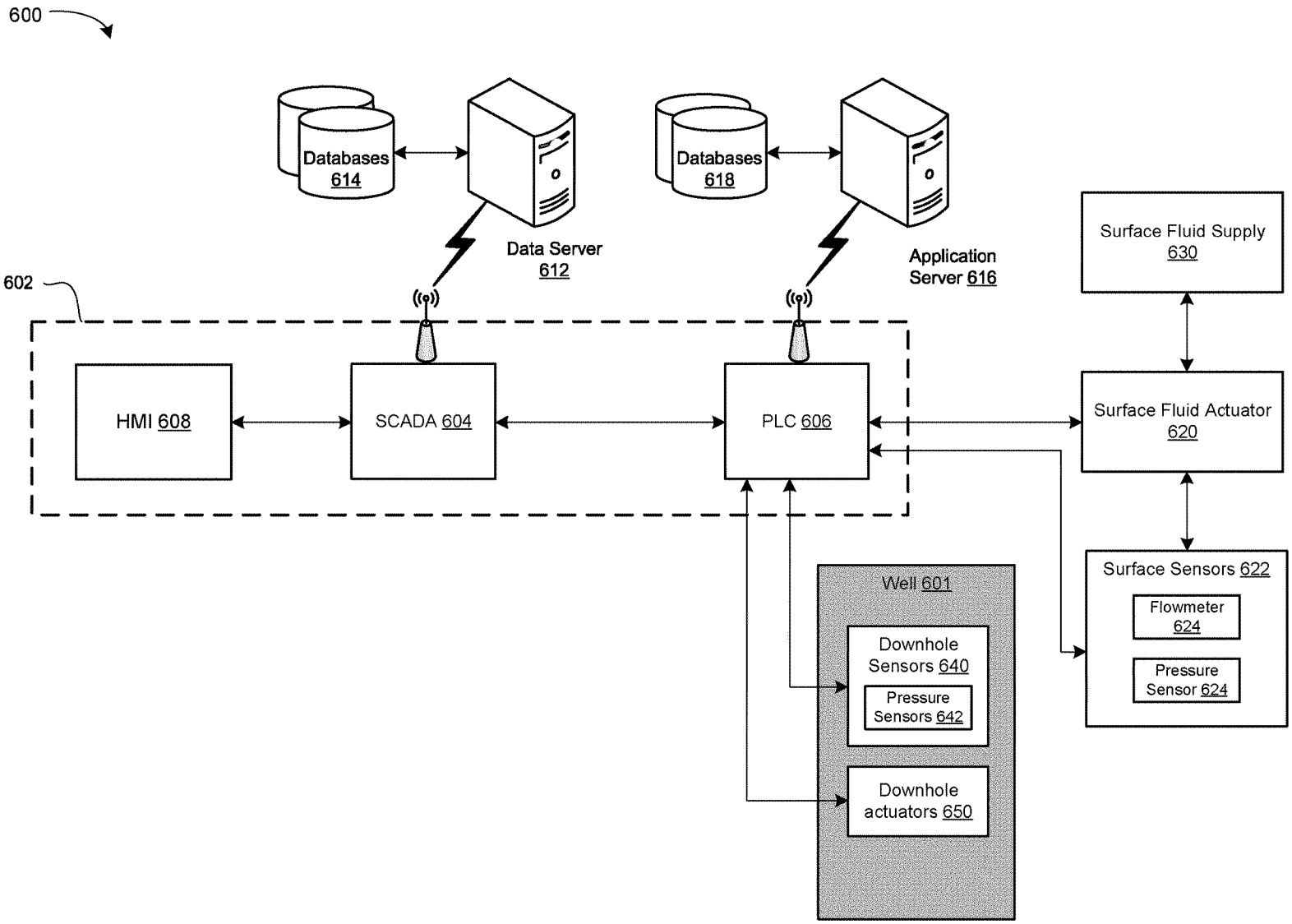
FIG. 6 is a schematic diagram of a system for operating hydrocarbon wells in accordance with an example embodiment of the present disclosure.

Reference is first made to FIG. 6 which illustrates a system 600 for operating hydrocarbon wells, e.g. oil wells 601, in accordance with one embodiment of the present disclosure. The system 600 may be used to operate one or more oil wells 601 in the same or different hydrocarbon reservoirs (e.g., petroleum or oil and gas reservoirs). The oil wells 601 may comprise injection wells, production wells, or a combination thereof. The system 600 comprises a number of control systems 602 (only one of which is shown in FIG. 6). Each control system 602 may control multiple wells 601 or a single well 601. The control systems 602 are located at the site of the respective wells 601. The control systems 602 comprise a supervisory control and data acquisition (SCADA) control system 604 coupled to a controller, such as a programmable logic controller (PLC) 606. A human machine interface (HMI) 608 is coupled to the SCADA control system 604. The HMI 608 typically comprises a visual interface provided by a display that provides a graphical user interface (GUI) that displays operating data and information about the respective well 601, and an input interface for receiving user input provided by one or more input devices such as keyboard and mouse. The HMI 608 may optionally comprise a microphone and a speaker, for example, for speech recognition.

The PLC 606 is coupled to downhole sensors 640 and downhole actuators 650 coupled to a respective valve (not shown) in a plurality of valves of a tubing string installed in the oil well 601. The tubing string may be any suitable type of tubing string including, but not limited to, an injection string, a production string or a lift gas conduit among other possibilities. The downhole sensors 640 sense one or more conditions at a respective valve. The downhole sensors 640 may comprise at least one pressure sensor 642 for each valve in the tubing string and optionally at least one temperature sensor for each valve in the tubing string. The PLC 606 is typically coupled to the downhole sensors 640 and the downhole actuators 650 via a wired communication path. The downhole actuators 650 are electronically controlled and may be actuated to open or close the respective valves many times.

The PLC 606 may also be coupled to a fluid actuator 620 located at the surface, such as a surface pump when the injection fluid is a liquid such as water or a compressor when the injection fluid is a gas, when the PLC 606 controls an injection well to maintain pressure, or cause a displacement process, in a hydrocarbon reservoir in a subterranean formation. The displacement process may be a secondary recovery process, such as waterflood, gas lift, natural gas flood or immiscible gas flood, or an EOR process, such as enriched miscible natural gas flood, miscible $CO_2$ flood, chemically enhanced water flood or water alternating gas (WAG) flood among other possibilities. The fluid actuator 620 may be a pump, compressor and/or flow regulator depending on the type of injection fluid being used, coupled to a fluid supply 630 located at the surface. The injection fluid may be water or a liquid that comprises substantially of water or compressed gas, such as $CO_2$, among other possibilities. The PLC 606 is also coupled to sensors 622 located at the surface that senses one or more parameters (or characteristics) of a fluid supplied to the respective well 601. The surface sensors 622 comprise a surface flowmeter 624 that measures a flow rate of an injection fluid and a pressure sensor 624 that measures a pressure of the injection fluid.

An additive supply and/or treatment supply (not shown) may also be provided. The additive supply and/or treatment supply may be connected to the PLC 606 and provides a source of a compound or composition that may be used with the injection fluid or instead of the injection fluid including, but not limited to one or more of, water, low salinity water, a dry gas, solvent, miscible gas, tracer, proppant, blocking agent, relative permeability modifying agent, surfactant, nanoparticulate or other additive which may be absorbed into the formation/reservoir. The additive supply and/or treatment supply may be connected to a mixer which is connected to the fluid supply 630 for mixing the compound or composition with the injection fluid, or may be connected directly to the fluid actuator 620 for directly injecting the compound or composition.

The PLC 606 may communicate with an application server 616 via a wired or wireless (e.g., cellular, Wi-Fi®, etc.) communication path, and with one or more databases 618 via the data server 616. The application server 616 may provide control information, such as optimization information, for operating the wells 601, namely for controlling the valves of the tubing string. The PLC 606 stores sensor data and derived data and information, such as injection data (e.g., flow rates and/or volumes) and/or production data (e.g., flow rates and/or volumes), relating to the operation of the respective wells 601. The PLC 606 communicates such data and information to the application server 616, which may store the data and information in the databases 618 as historical data for each of the wells 601. The historical data may comprise sensor data, operating settings or parameters such as valve position data relating to the open or closed state of the valves of the tubing string (e.g., a state of the tubing string or well 601), and derived data and information, such as production data over time (e.g., a time log). The data and information may comprise a time log of pressure data, temperature data, valve position/state (i.e., open or closed), and possibly derived flow rate or volume through each valve and/or possibly an interval specific reservoir characterization.

The SCADA control system 604 is typically used to communicate to or with an operator of the well 601. The system 600 is operated by the PLC 606 and/or the application server 616. The PLC 606 communicates with and provides the SCADA control system 604 with data and information relating to the operation of the respective wells 601. Typically, only a subset of the data and information of the PLC 606 is provided to the SCADA control system 604, such as a time filtered sample of one or more elements of the data and information mentioned above. The SCADA control system 604 may communicate with a data server 612 via a wired or wireless (e.g., cellular, Wi-Fi® etc.) communication path, and with one or more databases 614 via the data server 612. The SCADA control system 604 may provide the data server 612 with data and information, relating to the operation of the respective wells 601, which may store the data and information in the databases 614 as historical data for each of the wells 601.

Figure 7:
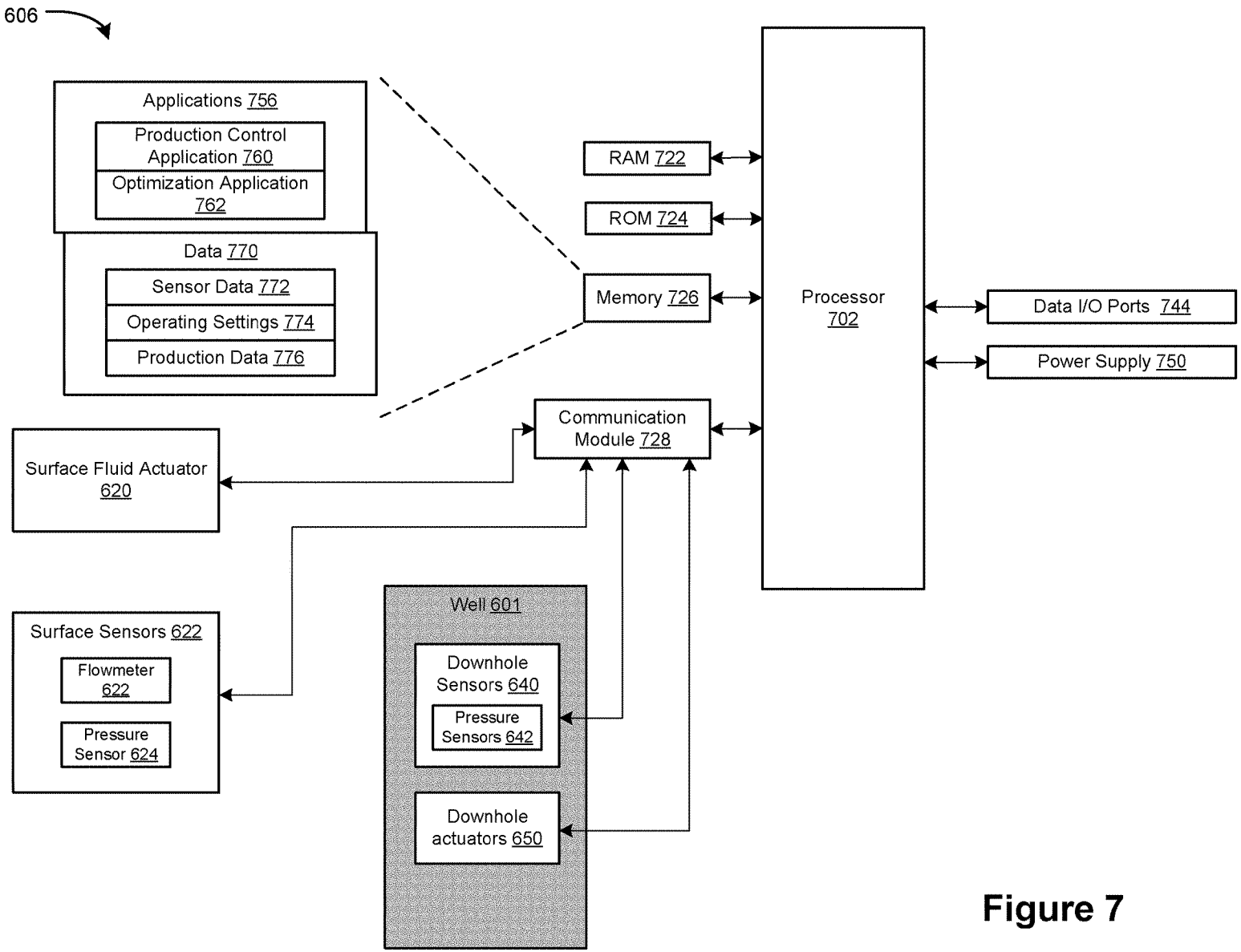
FIG. 7 is a block diagram of a programmable logical controller of the system of FIG. 6 in accordance with an example embodiment of the present disclosure.

Reference is next made to FIG. 7 which illustrates the components of a controller, such as PLC 606, of the system 600 of FIG. 6 in accordance with one example embodiment of the present disclosure. The PLC 606 comprises at least one processor 702 (such as a microprocessor) which controls the overall operation of the PLC 606. The processor 702 is coupled to a plurality of components via a communication bus (not shown) which provides a communication path between the components and the processor 702.

The processor 702 is coupled to RAM 722, ROM 724, persistent (non-volatile) memory 726 such as flash memory, and a communication module 728 for communication with the surface fluid actuator 620, surface sensors 622, downhole sensors 640 and downhole actuators 650. The processor 702 is also coupled to one or more data ports 744 such as serial data ports for data I/O (e.g., USB data ports), and a power supply 750.

The communication module 728 provides wired and/or wireless communication capabilities for communicating with an application server 616, surface fluid actuator 620, surface sensors 622, downhole sensors 640 and downhole actuators 650. Typically the communication module 728 is coupled to the downhole sensors 640 and downhole actuators 650 via a wired connection, such as a shared power and data line given space constraints and interference problems. The communication module 728 may comprise a wireless transceiver allowing the PLC 606 to communicate via one or any combination of cellular, Wi-Fi®, Bluetooth® or other short-range wireless communication protocol such as NFC, IEEE 802.15.7a (also referred to as UltraWideband (UWB)), Z-Wave, ZigBee, ANT/ANT+ or infrared (e.g., Infrared Data Association (IrDA)). The PLC 606 may use the communication module 728 to access the application server 616 via one or more communications networks, such as the Internet. The application server 616 may be located behind a firewall (not shown).

Operating system software 752 executed by the processor 702 is stored in the persistent memory 726 but may be stored in other types of memory devices, such as ROM 724 or similar storage element. A number of applications 756 executable by the processor 702 are also stored in the persistent memory 726 including a production control application 760, which may operate the respective well 601 in accordance with optimized operating settings or parameters based on sensor data acquired from the respective well 601 and determined by an optimization application 762 of the application server 616 and pushed down to the PLC 606. Alternatively, the optimization application may be installed and run by the PLC 606. The optimization application may be a machine learning or artificial intelligence based application. The memory 726 also stores a variety of data 770 including sensor data 772 acquired by the surface sensors 622 and downhole sensors 640, operating settings 774 such as optimized operating settings or parameters including, but not limited to valve position data relating to the open or closed state of the valves of the tubing string (e.g., a state of the tubing string or well 601), and production data 776.

System software, software modules, specific device applications, or parts thereof, may be temporarily loaded into a volatile store, such as RAM 722, which is used for storing runtime data variables and other types of data or information. Communication signals received by the PLC 606 may also be stored in RAM 722. Although specific functions are described for various types of memory, this is merely one example, and a different assignment of functions to types of memory may be used in other embodiments.

Figure 8:
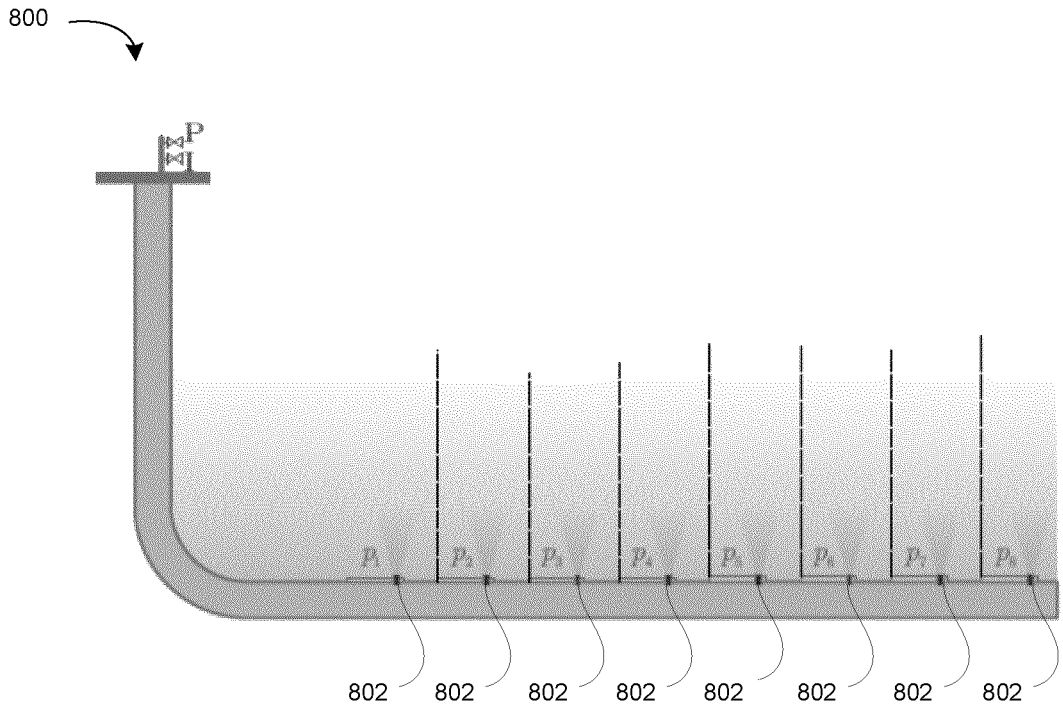
FIG. 8 is a schematic illustration of an example injection well with which example embodiments of the present disclosure may be applied.

FIG. 8 is a schematic illustration of an example horizontal injection well having a tubing string, i.e. an injection string 800, installed therein with which example embodiments of the present disclosure may be applied. The injection string 800 comprises a plurality of flow communication stations (or also known as valves). In the example of FIG. 8, the injection string 800 has 8 valves. However, any number of valves may be present. Each of the valves 802 is equipped with at least one pressure sensor for measuring a pressure of the formation in which the injection string 800 is located, denoted $p_1, p_2, \ldots p_8$, at the location of the respective valve 802. Each valve has an actuator 650 adapted to change a position or the state of respective valve 802, from either open or closed. Each of the valves 802 may be separately opened or closed. The surface sensors 622 comprise a surface flowmeter that measures the flow rate of an injection fluid at the surface and pressure sensor that measures a pressure of the injection fluid at the surface.

The controllable input parameters of the PLC 606 are the flow rate of the injection fluid at the surface, denoted I, the pressure of the injection fluid at the surface, denoted P, and the position or the state of valves 80, denoted $s_1, s_2, \ldots s_8$. The condition (also referred to state or position) of each valve is either fully open or fully closed. The measurable parameters are the pressure of the injection fluid at the surface (e.g., at the surface pump), the flow rate of the pressure of the injection fluid at the surface (e.g., at the surface pump), and the pressures at the location of each valve 802 (e.g., in proximity of each valve 802). Each valve 802 is sometimes referred to a "stage" of the tubing string, e.g. injection string 800.

Optimization Methods

Injection String

Figure 9:
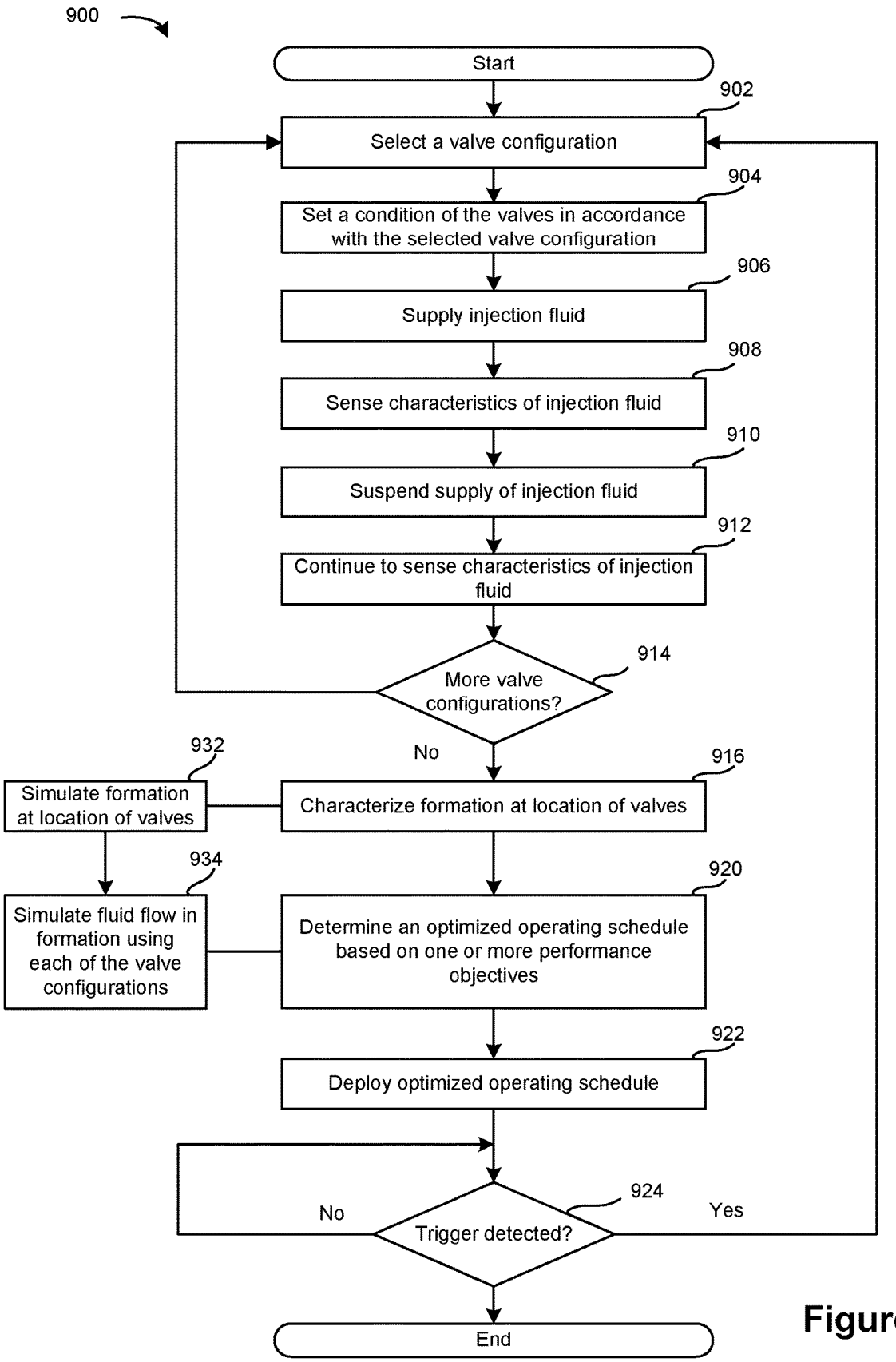
FIG. 9 is a flowchart of a method of optimizing operation of a hydrocarbon well in accordance with one example embodiment of the present disclosure.

Reference is next made to FIG. 9 which illustrates a flowchart of a method 900 of optimizing operation of one or more tubing strings by an apparatus in accordance with an example embodiment of the present disclosure. Each tubing string is located in a hydrocarbon well 601 and has a plurality of valves. Each valve is actuatable between a fully open position and a fully closed position. Each valve is in communication with a respective zone of a formation defining a reservoir containing hydrocarbon material. The apparatus that performs the method 900 may be the PLC 606 or the application server 616.

The method 900 may be used during a filling phase in which a formation is being charged or an operating phase in which the formation is substantially charged with the injection fluid and are formation substantially free of voidage. In each phase, different performance objectives may be optimized.

The method 900 may be used when the infectivity or the hydraulic resistivity of the formation/reservoir in which the tubing string is located is relatively constant and the formation/reservoir may be modeled using analytic techniques, examples of which are described below. The method 900 may be performed after the one or more zones of the formation have been substantially charged with the injection fluid and are formation substantially free of voidage. This can be determined when the measured pressure reaches a maximum pressure and is relatively constant, i.e. the pressure varies less than a threshold, which may be less than 20%, preferably less than 10%, more preferably less than 5%. The duration of time for the pressure to reach the maximum pressure may vary, among other factors, depending on the injectivity of the formation/reservoir and the voidage or fillage of the formation/reservoir (which may in turn vary depending on whether or not the well 601 is a new completion, and if not, the length of time and manner in which previous production in the well 601 was achieved.

When tubing strings are in close proximity to each other and the fluid flow in the formation/reservoir in the proximity of the tubing strings is, or may be expected to interact, the optimization may be performed on more than one tubing string, which may be injection strings, production strings, or a combination thereof. It is also contemplated that the optimization may be performed for cyclical injection and production, sometimes referred to as "Huff and Puff", which may use the same tubing string (i.e., injection and production occur via valves in the same tubing string, but injection and production functions occur at different times and can use the same or different valves for injection and production). Alternatively, cyclical injection and production may use different tubing strings for injection and production (i.e., injection and production occur via different valves) by providing an injection string and production string in the same well. Cyclical injection and production is described, for example, in WO 2014/124533 A1, published Aug. 21, 2014 and WO 2013/130419 A1, published Sep. 6, 2013, the content of these documents being incorporated herein by reference.

In a first phase of the optimization, the injectivity of one or more zones of the formation is determined by characterizing techniques. The injectivity is a measure of a hydraulic conductance of the formation or the tendency of the formation to receive injection fluid. The injectivity can differ between valves/stages in the same formation. The injectivity is related to the permeability and hydraulic resistivity of the formation. In other embodiments, the formation may be characterized in accordance with the permeability and hydraulic resistivity rather than the injectivity.

At operation 902, the PLC 606 selects a first valve configuration from a set of all valve configurations to be analyzed. Each valve configuration is defined by a condition of the valves in which each valve is in either a fully open position or fully closed position. Each valve configuration is defined by a subset of the valves 802 being in the fully open condition and a subset of the valves 802 being disposed in the fully closed position. The set of valve configurations to be analyzed may comprise all operating states of the well 601 or a subset thereof. For example, the valve configurations to be analyzed may be selected from all possible valve configurations based on previous optimization during either the filling phase or operating phase. An operating state of the well 601 is a valve configuration in which at least one of the valves 802 is disposed in the fully open position. For n valves 802, there are $2^n-1$ operating states (i.e., $2n$ total states less the non-operating state in which all valves 802 are disposed in the fully closed position. The particular valves 802 that are disposed in the fully opened position and fully closed position is unique to each operating state of the well 601. The set of valve configurations to be analyzed and the selection of the first and subsequent valve configurations may be made automatically without user intervention or based on user input. For example, valve configurations in which valves exhibiting backflow.

In some examples, the valve configurations may be selected from suitable valve configurations (e.g., operating states without backflow) so that only one valve in the one or more tubing strings is open at a time. This may increase the accuracy and/or increase the efficiency of the optimization. In other examples, a number of valves 802 may be opened at the same time and corresponding zones of the formation characterized together, for example if the valves have been determined to be in similar reservoir type/quality by an earlier optimization sequence.

At operation 904, the PLC 606 causes a condition of the valves 802 to be set in accordance with the first valve configuration. The PLC 606 keeps track of the condition of each valve (either fully opened or fully closed), for example by storing the condition and/or each change in condition of each valve in memory, and opens or closes valves as required to cause the condition of the valves 802 to be set in accordance with the first valve configuration.

At operation 906, the PLC 606 causes an injection fluid to be supplied to the tubing string. The injection fluid during the characterizing phrase is typically water but may be any suitable injection fluid. The injection fluid is pumped into the well 601 and through the open valves 802 of the selected valve configuration into the formation/reservoir at the location of the open valves 802. The supply of the injection fluid causes the tubing string to be pressurized over time. The injection fluid may be supplied the pressure reaches, or is within a threshold of, a maximum pressure of a surface pump (or compressor). The duration of time for the pressure to reach the maximum pressure is typically a function of the surface pump/compressor, may vary from possibly as little as a few hours to several days or weeks. The duration of time for the pressure to reach the maximum pressure may vary, among other factors, depending on the injectivity of the formation/reservoir and the voidage or fillage of the formation/reservoir (which may in turn vary depending on whether or not the well 601 is a new completion, and if not, the length of time and manner in which previous production in the well 601 was achieved.

At operation 908, one or more characteristics of the injection fluid are sensed, for example, a pressure of the injection fluid is sensed/measured at one or more locations. The pressure may be measured by the surface pressure sensor 624, the downhole pressure sensors 642 of the open valves of the selected valve configuration, or both. The downhole pressure sensors 642 may be used to measure the pressure at the location of the open valves. When the pressure is measured by the surface pressure sensor 624, a pressure at the location of the open valves and/or the zones of the formation in communication with the open valves is determined based on the surface pressure, $P_s$, and the fluid dynamics.

At operation 910, the supply of the injection fluid at the open valves is suspended or ceased. This may be caused by closing the open valves, stopping the surface pump/compressor, or both.

At operation 912, the one or more characteristics of the injection fluid are sensed, e.g. the pressure of the injection fluid is measured, at one or more locations after the supply of the injection fluid at the open valves is suspended or ceased. This continues until a termination condition is detected. The termination condition may be time based (e.g., expiry of a countdown timer from at time at which the when the supply of the injection fluid at the open valves is suspended or ceased) or pressure based (e.g., the measured pressure falls below a threshold pressure). Thus, the measuring of pressure starts before the pumping is suspended/ceased and continues for a set duration after the supply of the injection fluid at the open valves is suspended/ceased or until the measured pressure drops below a pressure threshold. The measured pressure should decrease over time after the supplying (e.g., pumping) of the injection fluid has been suspended/ceased. The surface pressure sensor 624 and/or pressure sensor 642 transmits the measured pressure to the PLC 606.

At operation 914, the PLC 606 determines whether any valve configurations in the set of valve configurations to be analyzed have yet to be analyzed. When one or more valve configurations to be analyzed remain, the method returns to operation 902 at which another valve configuration is selected. The selection may be made automatically without user intervention or based on user input, for example, in accordance with a positional sequential (i.e., a sequence based on the position of the valves 802 in the tubing string) or otherwise. For example, when the oil well 601 is a horizontal well, the valves may be opened in sequence from the heel to the toe of the horizontal well, with only one valve open at a time. Operations 902 to 914 are repeated until all valve configurations in the set of valve configurations to be analyzed have been analyzed.

When no valves remain, the method proceeds to operation 916 at which the formation/reservoir with which the tubing string is in communication is characterized based on the measured pressures. The formation/reservoir may be characterized by the PLC 606 or the application server 616, typically by the application server 616. When the formation/reservoir is characterized by the application server 616, the measured pressure data is transmitted from the PLC 606 to the application server 616 via the communication module 728, for example via the wireless transceiver of the communication module 728 of the PLC 606.

The characterization of the formation/reservoir may comprise calculating a flow coefficient for the area of the formation/reservoir in communication with each of the valves 802 in the tubing string based on the measured or calculated pressure at the respective valve 802 and other parameters such as the measured temperature at the respective valve 802, inferred pressure of the formation at the respective valve, surface flow rate and injection fluid composition. The flow coefficient may be calculated by the PLC 606 or the application server 616. The flow coefficient may be a hydraulic resistance or conductance. The flow coefficient for each of the one or more zones of the formation may be calculated in accordance with changes in a pressure or a flow rate of injection fluid associated with the respective zone of the formation after suspending/ceasing to supply injection fluid. Therefore, each segment of the respective formation attributed to each valve may be considered an orifice and modelled as such for simulation and optimization purposes. The flow rate may be determined from the pressure of injection fluid associated with the respective zone of the formation after suspending/ceasing to supply injection fluid acquired in preceding operations described above.

Figure 10:
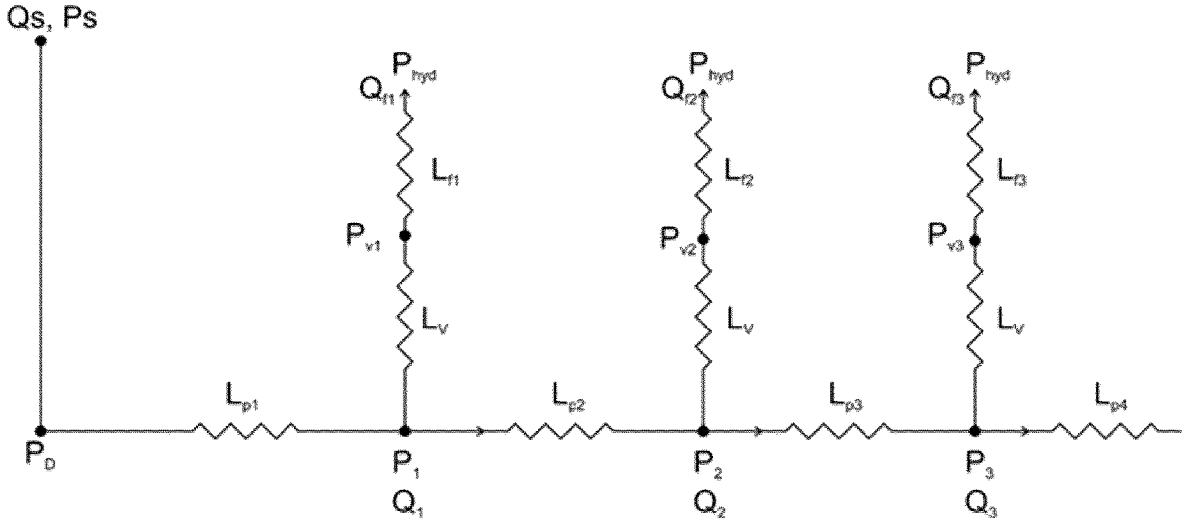
FIG. 10 is a schematic pressure diagram for a tubing string having a plurality of valves in accordance with one example embodiment of the present disclosure.
Figure 11:
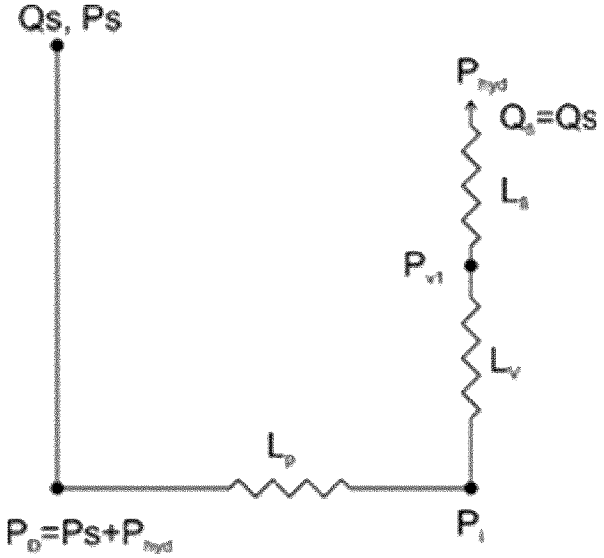
FIG. 11 is a schematic pressure diagram for a valve in a tubing string in accordance with one example embodiment of the present disclosure.

FIG. 10 is a pressure diagram of a tubing string of a horizontal injection well having multiple valves and FIG. 11 is a pressure diagram of a first valve in the tubing string of the horizontal injection well. The pressure at depth, denoted $P_D$, is known from the pressure of the injection fluid at the surface and wellbore geometry. $P_D=P_s+P_{hyd}$, wherein $P_s$ is the pressure of the injection fluid at the surface (i.e., pump pressure) which is known or measurable using the surface sensors 622, and $Q_s$ is the flow rate of the injection fluid at the surface which is known or measurable using the surface sensors 622.

The calculated flow coefficient may be Lohm resistivity. The Lohm resistivity of the formation in communication with a particular valve, denoted $L_{fi}$, may be calculated using the following equation:

$$L_{fi} = \sqrt{L_t^2 - L_v^2 - L_P^2} = \sqrt{\left(\frac{20\sqrt{P_s}}{Q_s}\right)^2 - L_v^2 - L_P^2}$$

wherein $$P = \frac{Q^2 L^2}{400}, \text{ and}$$

$$Q = \frac{20\sqrt{P}}{L},$$

wherein $Q_s$ is the flow rate of the injection fluid at the surface, $P_s$ is the pressure of the injection fluid at the surface, $L_v$ is pressure drop along the valve which is known or may be calculated using known pressure drop equations and known valve parameters, and $L_P$ is the pressure drop along the tubing string which is known or may be calculated using pressure drop equations and known tubing string parameters, suitable pressure drop equations being well known in the art. Alternative calculations can be performed in other embodiments using orifice calculation and manifold flow calculations well known in the art.

After the Lohm resistivity for the formation at the location of each valve 802 is calculated, a flow rate at each valve 802 of the tubing string may be calculated during operating using a pressure at the location of the respective valve 802 measured from the downhole pressure sensors 642 and the Lohm resistivity of the respective zone of the formation when the Lohm resistivity is relatively constant, i.e. when the variation in the Lohm resistivity of the respective zone of the formation is less than a threshold.

The formation/reservoir may be characterized in accordance with an injectivity type in accordance with the calculated flow coefficients. In some examples, the injectivity types are low injectivity (also known as accumulator type) and high injectivity (also known as orifice type). In other examples, the injectivity types are low injectivity, high injectivity, and short/fault. In other embodiments, the formation/reservoir may be characterized in accordance with four injectivity types: low injectivity, medium injectivity, high injectivity, and short/fault. More and/or different injectivity types are possible in other embodiments. The short/fault type represents a region of the formation/reservoir which substantially maintains the accumulated injection fluid after the pumping has been suspended/ceased rather than slowly releasing the injection fluid. This may occur as a result of a variety for geologic characteristics in the formation or due to a short or fault in the valve, the details of which are outside of the scope of the present disclosure.

The characterization of the formation/reservoir may comprise generating a simulation of the formation/reservoir (modelling the formation/reservoir) using simulation software, such as the Simscape Fluids module of Matlab Simulink™ based on tubing string parameters (e.g., valve number and characteristics, pipe diameter, length, etc.), calculated flow coefficients, injection fluid composition and other factors as is known in the art (operation 932). Within the simulation of the formation/reservoir, each valve 802 may be modelled with a pressure boundary condition in the simulation software.

In a second phase of the optimization, an optimal operating schedule is determined for operating the one or more tubing strings. The optimization may be performed by the PLC 606 or the application server 616, typically by the application server 616. When the optimization is performed by the application server 616, the measured pressure data is transmitted from the PLC 606 to the application server 616 via the communication module 728 if not already provided. The optimization is performed by an optimization application 762, which may be a machine learning (ML) or artificial intelligence (AI) based application which may be, or comprise, a genetic algorithm, simulated annealing, heuristic algorithm, controlled random search, a neural network or other suitable ML or AI-based technique, as described above.

The optimization application 762 may apply one or both of global and local optimization methods to achieve an optimum solution for the optimization problem. The global optimization methods may be used comprise one or a combination of DIRECT or the Dividing RECTangles, DIRECT-L (locally biased), controlled random search with local mutation, or improved stochastic ranking evolution strategy. A round of the Subplex method may be applied to results from the global methods (Steven G. Johnson, Nanostructures and Computation, MIT Code repository: https://github.com/stevengj/nlopt, the content of which is incorporated herein by reference). The local optimization methods that may be used comprise one or a combination of Nelder-Mead Simplex (gradient free) and Subplex (gradient free).

At operation 920, an optimal operating schedule is determined in accordance with the characterization of the one or more zones of the formation and one or more performance objectives. The optimization application 762 outputs an optimal operating schedule. The optimal operating schedule comprises one or more valve configurations and an operating duration for each of the one or more valve configurations. Each performance objective is defined by an objective function. When more than one performance objective function is to be optimized, the optimization is a multi-objective optimization (MOO) problem and one or more joint optimization techniques are used to solve the MOO problem which may use local or global optimization techniques.

The one or more performance objectives to be optimized may related to a single valve, a subset or group of valves that define a zone of the formation/reservoir that are interacting/operating together and/or have similar injectivity (this allows zone optimization or treatment in which one or more groups of valves operate together based on reservoir similarity), or all valves in the plurality of valves in the tubing string. Each zone may be operated differently and for different periods of time in accordance with the optimized operating schedule. The performance objectives may be based on any suitable type of injection fluid, examples of which are described above, including but not limited to water, $CO_2$, enriched field gas, steam or other suitable injection fluid. Zone treatment may be used for one or more of a number of possible treatments including, but not limited to, delivering a solvent (such as a miscible gas), tracer, proppant, blocking agent, relative permeability modifying agent, water, water with added or reduced (relative to reservoir water) salt concentration, and/or polymeric or surface active agents, or other additive which is then absorbed into the formation/reservoir. Zone treatment may be used as part of a "Huff and Puff" enhanced oil recovery process, hydraulic fracturing, or other treatment. The one or more performance objectives may change over time, for example, based on the life of the well, interaction with the wells, etc. For example, if the formation/reservoir has not received prior injections, a performance objective may be to continue injection into a zone as long as the injection rate or pressure for that zone remains above a threshold. During a steady state or quasi-steady state when the formation/reservoir has been substantially filled with injection fluid, the operating parameters may be different and lower tolerances or changes in pressure and flow can trigger re-characterization and/or re-optimization.

Examples of the objectives that may be optimized include, but are not limited to, one or more of evenly distributing the flow of the injection fluid through one or more valves in the plurality of valves, minimizing the difference in the flow of the injection fluid through one or more valves, maximizing the flow of the injection fluid through one or more valves, maximizing an accumulated volume of injection fluid injected through one or more valves, maintaining the surface pressure at a desired value, minimizing the number of changes in valve position/state change, isolating the flow of the injection fluid through one or more valves, distributing the flow of the injection fluid through one or more valves by predetermined differing amounts, receiving the injection fluid through one or more valves in response to back pressure or under pressure from a surface pump, back producing fluids from the reservoir in response to pressure drawdown at the well, closing all valves to enable pressure testing of the well or well servicing, or closing one or more valves to enable soaking one or more zones of the formation in communication with the one or more valves, for example with an EOR solvent fluid. The one or more performance objectives comprise one or more of evenly distributing the flow of the injection fluid or maximizing the flow of the injection fluid through the valves in some examples.

To determine the optimal operating schedule, the flow rate at each valve, denoted $Q_{fi}$, may be calculated using the calculated flow coefficients (e.g., Lohm resistivity $L_{fi}$) for the respective valve and the pressure, $P_{vi}$, at the location of each valve, which may be obtained from the respective downhole pressure sensor 642 at the respective valve or determined/derived from the pressure sensor 624 at the surface using one of the following equations:

$$Q_{fi} = \frac{20\sqrt{P_{vi} - P_{hyd}}}{L_{fi}}$$

or $$Q_{fi} = \frac{20\sqrt{P_i - P_{hyd}}}{\sqrt{L_{f1}^2 + L_v^2}}$$

wherein $P_{hyd}$ is the hydraulic pressure of the fluid in the tubing string at the respective valve, which is known or may be calculated from wellbore geometry.

Alternatively, in a first alternative method, to calculate the flow rate of the first stage, $Q_{f1}$, $P_1$ and $P_2$ may be calculated using the following equations:

$$P_1 = P_D - \frac{Q_S^2 L_{P1}^2}{400}, \text{ and}$$

$$Q_1 = Q_2 + Q_{f1} = \frac{20\sqrt{P_1 - P_2}}{L_{P2}} + \frac{20\sqrt{P_1 - P_{hyd}}}{\sqrt{L_{f1}^2 + L_v^2}}$$

wherein $$Q_2 = \frac{20\sqrt{P_1 - P_2}}{L_{P2}},$$

-continued $$Q_{f1} = \frac{20\sqrt{P_1 - P_{hyd}}}{\sqrt{L_{f1}^2 + L_v^2}}, \text{ and}$$

$$Q_s = \frac{20\sqrt{P_D - P_1}}{L_{P1}}.$$

$Q_{f1}$ may be calculated from the pressure sensor measurement $P_{v1}$ from surface from the following equation:

$$Q_{f1} = \frac{20\sqrt{P_1 - P_{v1}}}{L_v}$$

To calculate the flow rate of the second stage, $Q_{f2}$, $P_3$ is calculated using the following equation:

$$Q_2 = Q_3 + Q_{f2} = \frac{20\sqrt{P_1 - P_2}}{L_{P2}} = \frac{20\sqrt{P_2 - P_3}}{L_{P3}} + \frac{20\sqrt{P_2 - P_{hyd}}}{\sqrt{L_{f2}^2 + L_v^2}}$$

wherein $$Q_2 = \frac{20\sqrt{P_1 - P_2}}{L_{P2}},$$

$$Q_3 = \frac{20\sqrt{P_2 - P_3}}{L_{P3}}, \text{ and}$$

$$Q_{f2} = \frac{20\sqrt{P_2 - P_{hyd}}}{\sqrt{L_{f2}^2 + L_v^2}}.$$

$Q_{f2}$ may be calculated from pressure sensor measurement $P_{v2}$ from surface from the following equation:

$$Q_{f2} = \frac{20\sqrt{P_2 - P_{v2}}}{L_{v2}}$$

Using similar calculations derived for the remaining stages, the flow rates of the remaining stages are calculated.

Determining the optimal operating schedule may comprise generating a simulation of fluid flow within the simulation of the formation/reservoir is generated using simulation software, such as the Simscape Fluids module of Matlab Simulink™ (operation 934). The simulated fluid flow within the simulation of the formation/reservoir is analyzed to determine the one or more one or valve configurations and operating duration for each of the one or more valve configurations which optimizes the one or more performance objectives.

At operation 922, the optimized operating schedule is deployed or applied to the tubing string by the PLC 606. When the optimization is performed by the application server 616, the optimized valve configuration is transmitted from the application server 616 to the PLC 606 to via the communication module 728, and stored in memory 726. The PLC 606 then sets a condition of the valves in the one or more tubing strings in accordance with the optimized operating schedule via the downhole actuators 650 coupled to the valves, and causes injection of an injection fluid into at least some of the one or more tubing strings in accordance with the optimal operating schedule.

At operation 924, the PLC 606 monitors to detect for one or more triggers for re-optimization. Alternatively, an operator may monitor for the one or more triggers. The triggers may be set or changed at each optimization to reflect changes in the formation/reservoir, changes in the performance objectives, or changes in the tubing strings (e.g., short/fault) among other factors. The triggers may be automatically changed by the PLC 606 in some embodiments. When a trigger to perform re-optimization is detected, the method 900 returns to operation 902. The one or more triggers for which the PLC 606 monitors may be time-based, sensor-based and/or event-based, as described below.

The flow coefficients (e.g., dynamic resistivity) of the formation/reservoir will change over time at which time re-optimization should be performed, for example, the flow coefficients may change as reservoir penetration progresses. The flow coefficients may change with the cumulative volume injected over time, the properties of the injected fluid (e.g., EOR fluids), changes to formation saturation (e.g., water saturation, oil saturation and/or gas saturation), and injection influenced formation pressure relative to a bubble point. The flow coefficients may change relative to threshold pressures for opening waterflood and gas flood induced fractures including microfractures.

The one or more triggers may be time-based, sensor-based and/or event-based. An example of a time-based trigger may be the expiry of a countdown timer. The duration of the timer may be set for an optimization period. The optimization period defines a duration for (re) optimization. The optimization period may be defined as a predetermined number of days, weeks or months. The optimization period may vary between wells 601, formations/reservoirs etc., or may change over time over the life of the well or based on the maturity of the EOR scheme. The duration of the optimization period may increase in length overtime as the characterization of the well improves. For example, the optimization period may start monthly then increasing to biannually and eventually annually. The optimization period may be automatically increased, for example, as the operation of the well stabilizes over time, as determined by decreasing differences between optimization parameters (e.g., flow coefficients) on subsequent optimizations.

As an example of a sensor-based trigger is a pressure-based trigger. The pressure-based trigger may be a threshold change in the determined pressure (i.e., the pressure of the formation) for one or more valves. When the determined pressure for one or more valves change by more than a threshold amount without a corresponding and related flow rate change, the flow coefficients of the one or more zones formation/reservoir at the location of the respective valves has changed by an amount sufficient to perform re-optimization so that the one or more zones formation/reservoir may be re-characterized and the flow coefficients can be recalculated. Another example of a sensor-based trigger is a temperature-based trigger. Temperature is typically measured throughout the method 900 via a temperature sensor in each of the valves 802. When the temperature measurement for one or more valves reaches a threshold temperature, re-optimization is performed.

As an example of an event-based trigger, a trigger may be occurrence of treatment at the well or a nearby well such as offsetting production or injection well (e.g., hydraulic fracturing treatment at an offsetting well or EOR injection at an offsetting well). Another example of an event-based trigger is accumulated volume of injection fluid injected through one or more valves or produced from one or more valves. For example, using the flow rate the accumulated volume of fluid injected into a well or produced from a well can be determined. The trigger may be an accumulated volume of injection fluid or production fluid in a given period of time. Yet another example of an event-based trigger is an injection rate (i.e., flow rate of injection fluid). If the total flow rate is determined to below a threshold, the flow rate of a particular valve/stage is determined to below a threshold, or a reduction in the flow rate at any valve/stage which exceeds a threshold is determined, re-characterization and re-optimization is performed. The injection rates for the trigger may change over time. For example, during a reservoir start-up stage, the operational scheme may favor a high injection rate and the injection rate for the trigger may be higher than a later stages.

Figure 12:
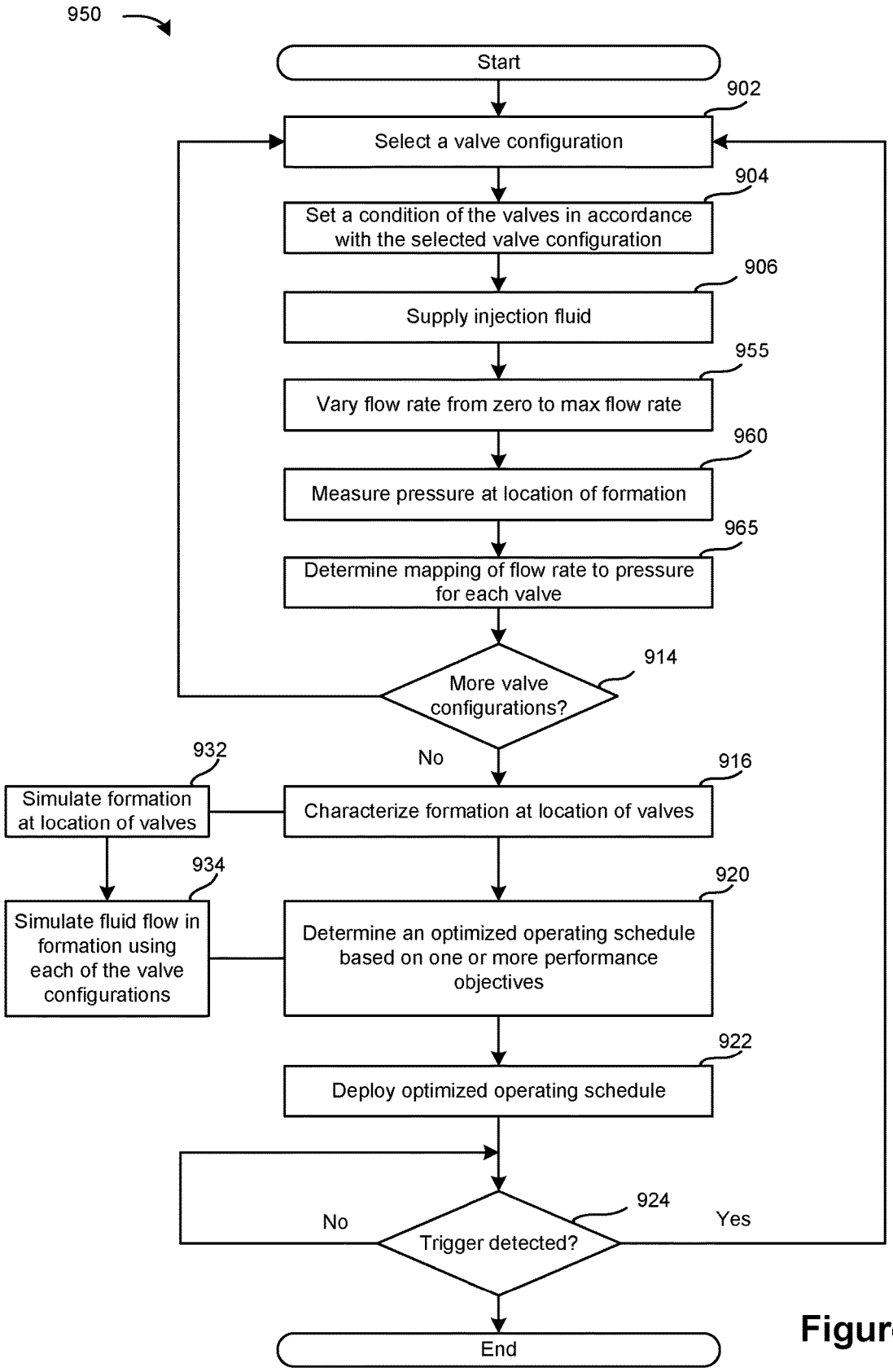
FIG. 12 is a flowchart of a method of optimizing operation of a hydrocarbon well in accordance with another example embodiment of the present disclosure.

Reference is next made to FIG. 12 which illustrates a flowchart of a method 950 of optimizing operation of one or more tubing strings by an apparatus in accordance with another example embodiment of the present disclosure in accordance with another example embodiment of the present disclosure. The method 950 may be used when the hydraulic resistivity of the formation/reservoir in which the tubing string is located is not relatively constant. The method 950 differs from the method 900 in the characterization phase. The apparatus that performs the method 900 may be the PLC 606 or the application server 616.

After the tubing string is pressurized with the injection fluid, at operation 955 the PLC 606 causes an electrically controlled valve at the surface, such as solenoid valve, is used to vary the flow rate of the injection from zero to a maximum flow rate which may be, for example, 100 $m^3$/day).

At operation 960, the downhole pressure sensor 642 of the open valve is used to measure the pressure of the formation at the location of the open valve while the flow rate is being varied from zero to maximum flow rate.

At operation 965, a relationship or mapping of flow rate to pressure for the valve is determined by the PLC 606 or the application server 616. When the relationship between flow rate and pressure is determined by the application server 616, the flow rate data from the solenoid valve and the pressure data from the downhole pressure sensor 642 of the open valve is transmitted from the PLC 606 to the application server 616 via the communication module 728, for example via the wireless transceiver of the communication module 728 of the PLC 606. The mapping of flow rate to pressure for the valve is then used to characterize the formation/reservoir.

The methods 900 and 950 may be performed automatically without user intervention. For example, the system 600 may permit the operating schedule of one or more tubing strings in one or more wells to be optimized and re-optimized as required without interaction by a human operator. This may increase the speed of optimization, reduce the amount of downtime, reduce the amount of production time with a sub-optimal valve configuration, reduce time between optimizations, and improve the optimization of the valve configuration for one or more tubing strings in one or more wells, thereby improving the production of the area affected by the configured valves.

Figure 13:
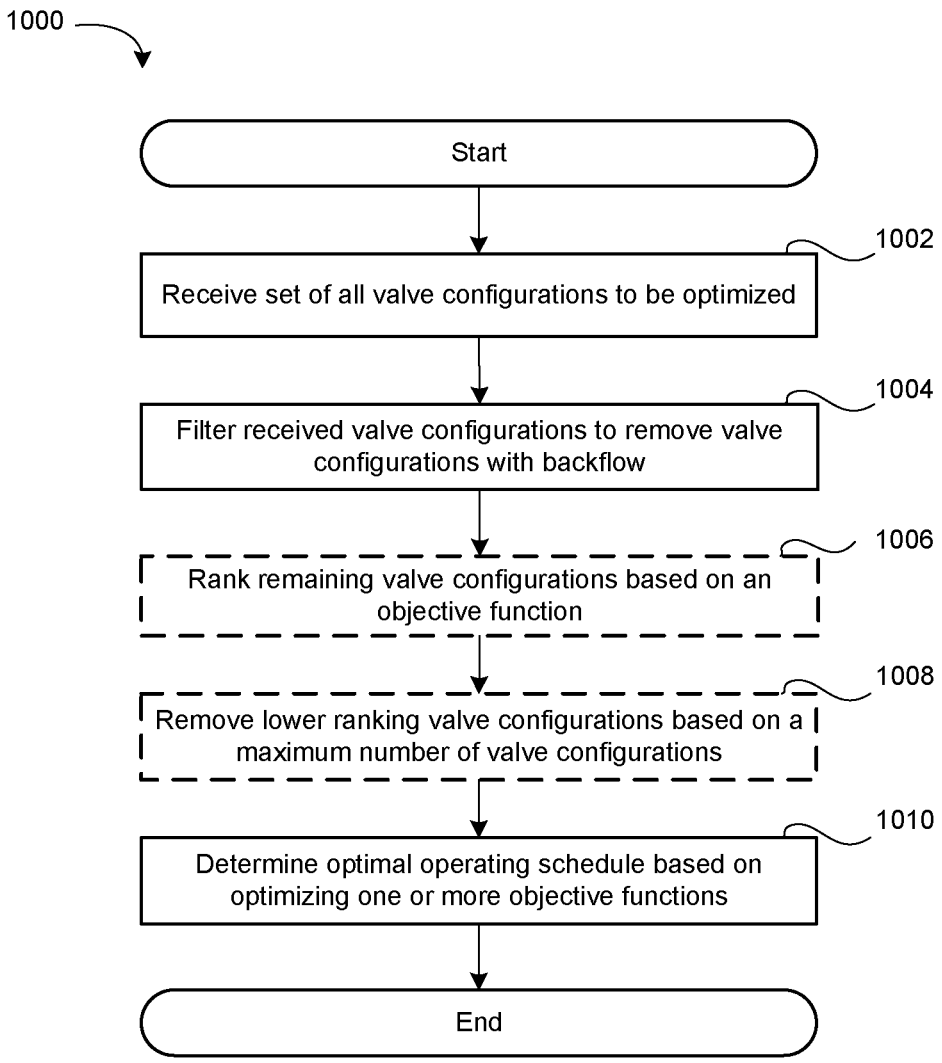
FIG. 13 is a flowchart of a method of determining an optimal operating schedule in accordance with one example embodiment of the present disclosure.

Reference is next made to FIG. 13 which illustrates a flowchart of a method 1000 of determining an optimal operating schedule by an apparatus in accordance with an example embodiment of the present disclosure. The apparatus that performs the method 1000 may be the PLC 606 or the application server 616. The method 1000 may be used to perform the optimization operation 920 of method 900 or 950 described above.

At operation 1002, a set of valve configurations for one or more tubing strings to be analyzed is received by the apparatus. Each valve configuration may be encoded as a bit string. For example, the state of each valve may be encoded by either "0" or "1", wherein "0" represents the valve being open and "1" represents the valve being closed. For example, for a tubing string having 8 valves, the state of the valves, $s_8$, $s_7$, $s_6$, $s_5$, $s_4$, $s_3$, $s_2$, $s_1$, may be represented by the bit string 11001001 in which the valve 1 is closed, valve 2 is open, valve 3 is open, valve 4 is closed, valve 5 is open, valve 6 is open, valve 7 is closed, and valve 8 is closed. Different data structures may be used to encode the valve configuration in other embodiments. For example, each representation may be stored as a vector of values, such as a vector of real numbers, in other embodiments.

The set of valve configurations to be analyzed may be all possible valve configurations or a subset thereof. The number of possible valve configurations is $2^n-1$, where n is the number of valves in the tubing string (the valve configuration of all valves being closed being excluded from consideration as a possible valve configuration). As an example, for a tubing string having 8 valves, the number of possible valve configurations is $2^8-1$ or 255 valve configurations. set of valve configurations to be analyzed may be less than all possible valve configurations when an optimization has been previously performed and, for example, one or more valve configurations have been determined to have a fully opened valve in which backflow has been detected.

At operation 1004, the set of valve configurations is filtered to remove valve configurations that have been determined to have a fully opened valve in which backflow has been detected.

At operation 1006, the remaining valve configurations are ranked based on one or more performance objectives. In an example embodiment, the ranking may be based a total flow rate determined from the simulation of fluid flow within the simulation of the formation/reservoir, in which case the ranking may be defined in accordance with the following equation:

$$r_i = \frac{\sum_{j=1}^{n}(q_j)}{\sum_{j=1}^{n}\left|\frac{1}{n}\sum_{j=1}^{n}(q_j) - q_j\right|}$$

wherein r=1 . . . m, $m=2^n-1-n_{backflow}$, n is the total number of valves, and $n_{backflow}$ is the number of valves with backflow.

Alternatively, the ranking may be based on a different performance objective such as an evenness of the flow from all the valves.

At operation 1008, the remaining valve configurations are filtered to remove lower ranking configurations in accordance with a maximum number of valve configurations.

At operation 1010, objective functions for each of the one or more performance objectives are solved for the remaining m valve configurations after the filtering of operation 1008 to determine an optimal operating schedule comprising one or more valve configurations and operating duration for each of the one or more valve configurations which optimizes the one or more performance objectives. The remaining m valve configurations are the valve configurations with no backflow and the highest individual rankings are selected for optimization. In an example embodiment, the objective functions comprise a maximum flow function and either an even flow function or a joint maximum flow and even flow function. The maximum flow function outputs a fitness indicator with respect to achieving a maximum flow in a given period of time, i.e. the maximum flow rate. The maximum flow rate is the maximum of the total flow rate through all of the open valves in a particular valve configuration. The maximum flow fitness function is defined in accordance with the following equation:

$$f(W) = \sum_{i=1}^{m}\left(w_i \sum_{j=1}^{n} q_j\right)$$

The joint maximum flow and even flow fitness function outputs a fitness indicator with respect to achieving a maximum flow and even flow among all of the open valves in the valve configuration, i.e. the maximum flow rate and equal distribution. The joint maximum flow and even flow fitness function is defined in accordance with the following equation:

$$f(W) = \frac{\sum_{i=1}^{m} w_i \sum_{j=1}^{n} q_j}{\sqrt{\sum_{i=1}^{m} w_i \left(\sum_{j=1}^{n}(q_j - q_{avr})^2\right)}}$$

wherein $$q_{avr} = \frac{1}{n}\sum_{i=1}^{n} q_i$$

To determine one or more valve configurations and operating duration for each of the one or more valve configurations which optimizes the one or more performance objectives, the objective function(s) or fitness function(s) $f(W)$ are optimized either signally or jointly, depending on whether one or more objective function(s) or fitness function(s) are defined. In some examples, the objective function(s) or fitness function(s) $f(W)$ may be minimized using a Controlled Random Search (CRS) with local mutation and the Subplex methods as described in P. Kaelo and M. M. Ali, "Some variants of the controlled random search algorithm for global optimization," J. Optim. Theory Appl. 130 (2), 253-264 (2006), and T. Rowan, "Functional Stability Analysis of Numerical Algorithms", Ph.D. thesis, Department of Computer Sciences, University of Texas at Austin, 1990, the content of these documents being incorporated herein by reference. A different machine learning/artificial intelligence technique that applies a different heuristic algorithm may be used in other embodiments. Other suitable machine learning/artificial intelligence techniques include a genetic algorithm or other gradient free optimization routine such as Nelder-Mead, Subplex, etc.

The output of each of the above-noted optimization problems is the vector W, which is a vector of configuration weights $w_i$ for each of the valves defined in accordance with the following equation:

$$W = \begin{bmatrix} w_1 \\ w_2 \\ \vdots \\ w_m \end{bmatrix}$$

wherein each weight $w_i$ has a value between "0" and "1" which represents a fraction of time in an optimization period for which the optimization is valid. The total of each weight $w_i$ in the vector W totals 1.

An operating time of each valve configuration is calculated as fraction of the total operating time, $t_{tot}$, using the following equation:

$$t_i = \frac{w_i}{\sum_{j=1}^{m} w_j} t_{tot}$$

Each valve configuration will be active for $t_i$ period of time. At the end of the optimization period, the optimization method 1000 is re-run so that a new set of injectivity tests are performed and the formation/reservoir is re-characterized.

In other embodiments, the ranking and filtering operations 1006 and 1008 described above may be omitted and all valve configurations without backflow may be considered when performing the optimization of operation 1010, i.e. all valve configurations output from the filter operation 1004.

In accordance with a further aspect of the present disclosure, there is provided a method, performed by a processor of at least one apparatus, of operating one or more tubing strings, each tubing string located in a hydrocarbon well and having a plurality of valves, each valve being actuatable between a fully open position and a fully closed position, each valve being in communication with a respective zone of a formation defining a reservoir containing hydrocarbon material, the method comprising: for each injection string in the one or more tubing strings: (i) causing a condition of the valves to be set in accordance with an operating schedule, wherein the operating schedule comprises one or more valve configurations and an operating duration for each of the one or more valve configurations, wherein each valve configuration is defined by a condition of the valves in which each valve in the plurality of valves is in either the fully open position or the fully closed position; (ii) causing injection of an injection fluid into the formation through each open valve in the injection string in accordance with the operating schedule; (iii) monitoring to detect one or more triggers for optimizing the operating schedule; and (iv) repeating steps (i) to (iii) in response to detection of a trigger for optimizing operation of the operating schedule.

In accordance with a further aspect of the present disclosure, there is provided a method, performed by a processor of at least one apparatus, of operating one or more tubing strings, each tubing string located in a hydrocarbon well and having a plurality of valves, each valve being actuatable between a fully open position and a fully closed position, each valve being in communication with a respective zone of a formation defining a reservoir containing hydrocarbon material, the method comprising: for each injection string in the one or more tubing strings: causing a condition of the valves to be set in accordance with a valve configuration, wherein the valve configuration is defined by a condition of the valves in which each valve in the plurality of valves is in either the fully open position or the fully closed position; causing injection of an injection fluid into the formation through the injection string; determining a pressure associated with a respective zone of the formation in communication with each open valve; calculating a flow rate at each open valve using a flow coefficient for a zone of the formation in communication with each open valve and the determined pressure of the injection fluid; determining whether the flow rates at each open valve achieve one or more performance objectives; and causing valve configuration to be changed in response to a determination that the flow rates at each open valve do not achieve the one or more performance objectives.

Production String

Figure 14:
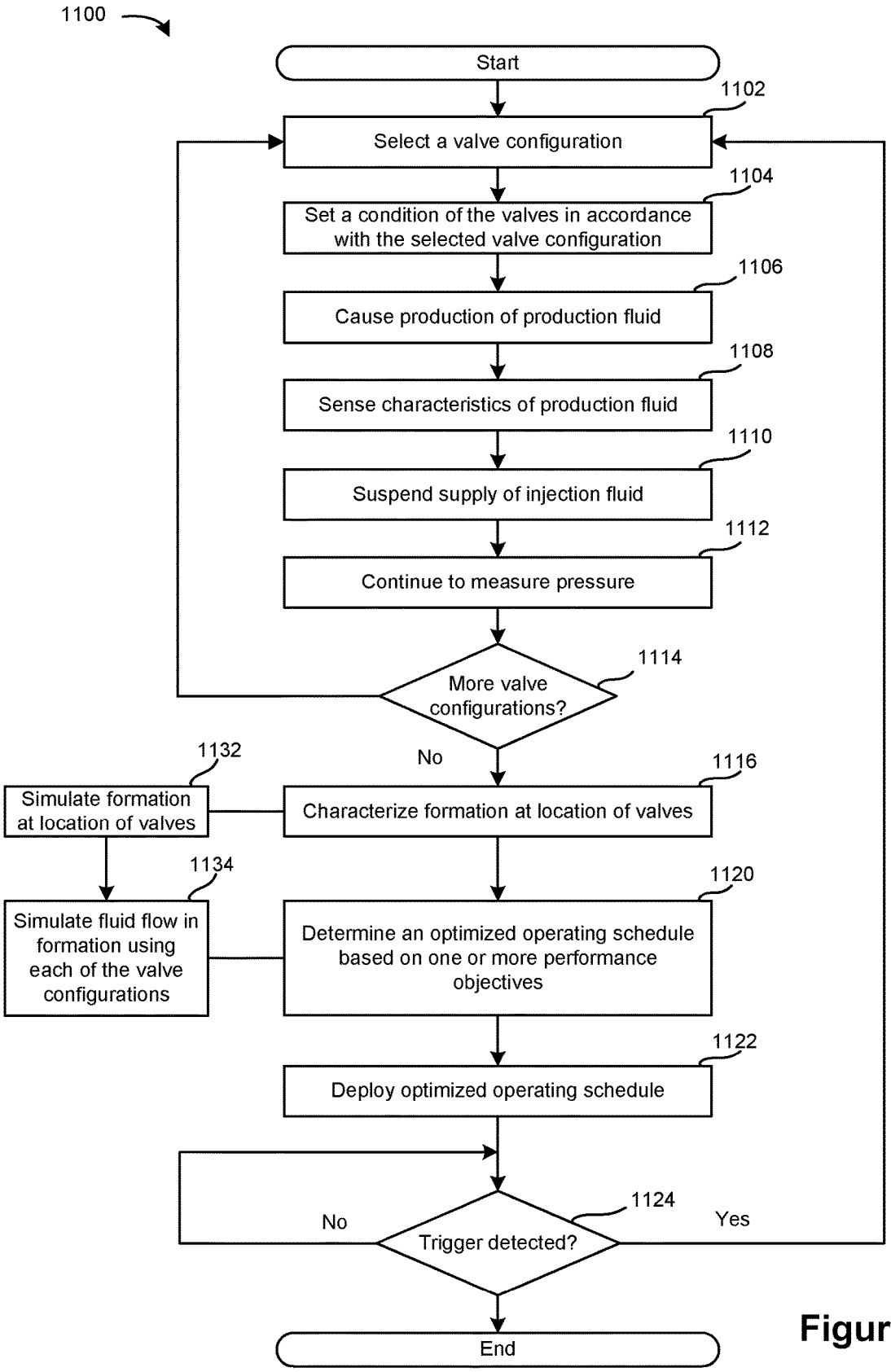
FIG. 14 is a flowchart of a method of optimizing operation of a hydrocarbon well in accordance with a further example embodiment of the present disclosure.

The methods of optimizing operation of one or more tubing strings by an apparatus described above, denoted 900 and 950, developed for injection strings may be adapted for use with production strings. FIG. 14 which illustrates a flowchart of a method 1100 of optimizing operation of one or more tubing strings by an apparatus in accordance with a further embodiment of the present disclosure. The method 1000 is similar to the method 900 expect that the tubing string is a production string. The apparatus that performs the method 1100 may be the PLC 606 or the application server 616.

At operation 1102, the PLC 606 selects a first valve configuration from a set of all valve configurations to be analyzed.

At operation 1104, the PLC 606 causes a condition of the valves 802 to be set in accordance with the first valve configuration. The PLC 606 keeps track of the condition of each valve (either fully opened or fully closed), for example by storing the condition and/or each change in condition of each valve in memory, and opens or closes valves as required to cause the condition of the valves 802 to be set in accordance with the first valve configuration.

At operation 1106, production of a production fluid from the formation through the production string is caused, for example, by supplying of the injection fluid to one or more nearby injection strings in one or more corresponding offsetting injection wells. This is caused by a PLC 606 of an injection string, which may be the same PLC 606 that controls the production string, or a different PLC 606 in communication with the PLC 606 of the production string or the application server 616.

At operation 1108, a pressure of the injection fluid is measured at one or more locations. The pressure may be measured by the surface pressure sensor 624, the downhole pressure sensors 642 of the open valves of the selected valve configuration, or both. The downhole pressure sensors 642 may be used to measure the pressure at the location of the open valves. When the pressure is measured by the surface pressure sensor 624, a pressure at the location of the open valves and/or the zones of the formation in communication with the open valves is determined based on the surface pressure, $P_s$, and the fluid dynamics.

At operation 1110, production of the injection fluid at the open valves is suspended or ceased. This may be caused by closing the open valves, stopping the surface pump/compressor of the one or more injection strings at the one or more offsetting injection wells, or both.

At operation 1112, one or more characteristics of the production fluid are sensed. This continues until a termination condition is detected. In some examples, the one or more sensed characteristics of the production flow comprise one or more of a pressure of the production fluid, an accumulated volume of the production fluid, hydrocarbon content of the production fluid, water content of the production fluid, and gas content of the production fluid. Uphole sensors 622 and/or downhole sensors 640 may be used. For example, the pressure of the production fluid may be sensed or measured at one or more locations after the supply of the injection fluid at the open valves is suspended or ceased. In some examples, the pressure of the production fluid is sensed by a pressure sensor of the one or more valves. In some examples, the pressure of the production fluid is sensed by a pressure sensor located within, or within a proximity of, the one or more valves. In some examples, each pressure sensor measures a pressure of a zone of the formation in communication with the respective valve. In some examples, the pressure of the production fluid is sensed by a pressure sensor located uphole of the valves. In some examples, the pressure of the production fluid is sensed by a pressure sensor located at the surface.

At operation 1114, the PLC 606 determines whether any valve configurations in the set of valve configurations to be analyzed have yet to be analyzed. When one or more valve configurations to be analyzed remain, the method returns to operation 1102 at which another valve configuration is selected. The selection may be made automatically without user intervention or based on user input, for example, in accordance with a positional sequential (i.e., a sequence based on the position of the valves 802 in the tubing string) or otherwise. For example, when the oil well 601 is a horizontal well, the valves may be opened in sequence from the heel to the toe of the horizontal well, with only one valve open at a time. Operations 1102 to 1114 are repeated until all valve configurations in the set of valve configurations to be analyzed have been analyzed.

When no valves remain, the method proceeds to operation 1116 at which a production flow and/or the formation/reservoir with which the tubing string is in communication is characterized based on the sensed characteristics, e.g. measured pressures or derivatives thereof. The formation/reservoir may be characterized by the PLC 606 or the application server 616, typically by the application server 616. When the formation/reservoir is characterized by the application server 616, the measured pressure data is transmitted from the PLC 606 to the application server 616 via the communication module 728, for example via the wireless transceiver of the communication module 728 of the PLC 606. In some examples, the characterizing is based on a pressure of the production fluid or an accumulated volume of the production fluid determined from the one or more sensed characteristics of the production fluid.

The characterization of the production flow and/or formation/reservoir may comprise generating a simulation of the formation/reservoir (modelling the formation/reservoir) using simulation software, such as the Simscape Fluids module of Matlab Simulink™ based on tubing string parameters (e.g., valve number and characteristics, pipe diameter, length, etc.), calculated flow coefficients, injection fluid composition and other factors as is known in the art (operation 1132). Within the simulation of the formation/reservoir, each valve 802 may be modelled with a pressure boundary condition in the simulation software.

At operation 1120, an optimal operating schedule is determined in accordance with the characterization of the production flow and/or one or more zones of the formation and one or more performance objectives. The optimization application 762 outputs an optimal operating schedule. The optimal operating schedule comprises one or more valve configurations and an operating duration for each of the one or more valve configurations. In some examples, the one or more performance objectives of the respective production string comprise minimizing the water content of the the production fluid, wherein the optimal operating schedule is configured to exclude valve configurations in which valves in communication with zones that produce substantially only water are open. The operation 1120 may be performed using the method 1000 of FIG. 13 or a method adapted therefrom.

At operation 1122, the optimized operating schedule is deployed or applied to the tubing string by the PLC 606. When the optimization is performed by the application server 616, the optimized valve configuration is transmitted from the application server 616 to the PLC 606 to via the communication module 728, and stored in memory 726. The PLC 606 then sets a condition of the valves in the one or more tubing strings in accordance with the optimized operating schedule via the downhole actuators 650 coupled to the valves, and causes injection of an injection fluid into at least some of the one or more tubing strings in accordance with the optimal operating schedule.

At operation 1124, the PLC 606 monitors to detect for one or more triggers for re-optimization. Alternatively, an operator may monitor for the one or more triggers. The triggers may be set or changed at each optimization to reflect changes in the formation/reservoir, changes in the performance objectives, or changes in the tubing strings (e.g., short/fault) among other factors. The triggers may be automatically changed by the PLC 606 in some embodiments. When a trigger to perform re-optimization is detected, the method 1100 returns to operation 1102. The one or more triggers for which the PLC 606 monitors may be time-based, sensor-based and/or event-based, as described below.

In some examples, the valve configurations may be selected so that production flow from each of the zones of the formation (e.g., production through each of the valves) is analyzed during the characterization stage.

Multiple Well/Tubing String Optimization

The methods described above may be performed for multiple tubing strings located in a formation, wherein each tubing string interacts with a common hydrocarbon reservoir well, wherein the method is performed for multiple tubing strings to jointly optimize the operation of the multiple tubing strings. The operation of the multiple tubing strings may be jointly optimized based on the characterizations of the one or more zones of the formation in communication with each of the multiple tubing strings and the one or more performance objectives of each of the multiple tubing strings or joint performance objectives for all of the wells. The optimization is based on characterization of one or more zones of the formation in communication with each of the tubing strings. The characterization for each tubing string may take into the account the interaction of nearby wells/string strings. The multiple tubing strings may comprise injection strings, production strings, or a combination thereof. The injection string and production string are located in different wells within proximity of each other, which the injection of the injection fluid into the injection string stimulates production in the production string. Alternatively, the injection string and production string may be located in the same well, wherein the injection string and production string are alternatively operated to provide cyclical injection and production from the same well.

It is also contemplated that the methods described above in connection with production strings can be applied to production strings comprising the flow communication stations without valving, i.e. flow communication stations which are always open and cannot be closed, by charactering each zone/flow communication station may controlling/varying the valve configurations of the one or more injection strings which are causing production in the production string. Similarly, the methods described above can be adapted so that in production strings comprising valves, the valves are always open but the valve configurations of the one or more injection strings which are causing production in the production string are controlled/varied.

Zone Treatments, Huff and Puff, Well-to-Well Displacement and Hybrid Processes

The teachings of the present disclosure may also be applied to methods of zone treatment, huff and puff, well-to-well displacement and hybrid processes.

In accordance with a further aspect of the present disclosure, there is provided a method, performed by a processor of at least one apparatus, of operating one or more tubing strings, each tubing string located in a hydrocarbon well and having a plurality of valves, each valve being actuatable between a fully open position and a fully closed position, each valve being in communication with a respective zone of a formation defining a reservoir containing hydrocarbon material, the method comprising: for a production string in the one or more tubing strings: causing a condition of the valves to be set in accordance with a valve configuration, wherein the valve configuration is defined by a condition of the valves in which each valve in the plurality of valves is in either the fully open position or the fully closed position; causing production of a production fluid from the formation through production string; determining a pressure associated with a respective zone of the formation in communication with each open valve; calculating a flow rate at each open valve using a flow coefficient for a zone of the formation in communication with each open valve and the determined pressure of the production fluid; determining whether the flow rates at each open valve achieve one or more performance objectives; and causing the valve configuration to be changed in response to a determination that the flow rates at each open valve do not achieve the one or more performance objectives.

In accordance with a further aspect of the present disclosure, there is provided a method, performed by a processor of at least one apparatus, of optimizing operation of one or more tubing strings, each tubing string being located in a hydrocarbon well and having a plurality of valves, each valve being actuatable between a fully open position and a fully closed position, each valve being in communication with a respective zone of a formation defining a reservoir containing hydrocarbon material, the method comprising: for each of the one or more tubing strings: characterizing an injectivity of each zone of the formation in accordance with sensed characteristics of an injection fluid; determining an operating schedule for operating the one or more tubing strings in accordance with the characterization of the zones of the formation and one or more performance objectives, wherein the operating schedule comprises a valve configuration and an operating duration for performing cyclical injection and production, wherein each valve configuration is defined by a condition of the valves in which each valve in the plurality of valves is in either the fully open position or the fully closed position.

In some examples, performing cyclical injection and production comprises: alternating between injecting injection fluid into one or more zones one or more zones and producing production fluid from one or more zones one or more zones.

In some examples, injection and production are performed using different valves in the same or different tubing.

In some examples, injection is performed via an injection string and production is performed via a production string, wherein the injection string and production string are located in the same well.

In some examples, and production are performed using the same valves.

In accordance with a further aspect of the present disclosure, there is provided a method, performed by a processor of at least one apparatus, of optimizing operation of one or more tubing strings, each tubing string being located in a hydrocarbon well and having a plurality of valves, each valve being actuatable between a fully open position and a fully closed position, each valve being in communication with a respective zone of a formation defining a reservoir containing hydrocarbon material, the method comprising: characterizing an injectivity of one or more zones of the formation in accordance with sensed characteristics of an injection fluid; determining one or more sets of zones based on an injectivity type of the one or more zones of the formation, each set comprising one or more zones; determining a set of zones to receive a treatment based on the injectivity type; determining an injection fluid for treating the set of zones based on the injectivity type; determining an operating schedule for treating the set of zones, wherein the operating schedule comprises one or more valve configurations and an operating duration for each of the one or more valve configurations, wherein each valve configuration is defined by a condition of the valves in which each valve in the plurality of valves is in either the fully open position or the fully closed position, wherein one or more valve configurations of the operating schedule isolate the flow of the injection fluid through one or more valves associated with the set of zones to be treated; and causing, a condition of the valves to be set in accordance with the operating schedule.

In accordance with a further aspect of the present disclosure, there is provided a method, performed by a processor of at least one apparatus, of optimizing operation of one or more tubing strings, each tubing string being located in a hydrocarbon well and having a plurality of valves, each valve being actuatable between a fully open position and a fully closed position, each valve being in communication with a respective zone of a formation defining a reservoir containing hydrocarbon material, the method comprising: identifying communicating zones of a first well in which a first tubing string is located which cause production of a production fluid in a second well in which a second tubing string is located in response to injection of an injection fluid in an injection string located in the first well; identifying non-communicating zones of the first well which do not cause production of a production fluid in a second well in response to injection of an injection fluid in an injection string located in the first well; and determining an operating schedule for operating the first and second tubing strings, wherein the operating schedule comprises a first valve configuration and a first operating duration for performing injection into the communication zones of the first well, and a second valve configuration and a second operating duration for performing cyclical injection and production on the non-communicating zones of the first well, wherein each valve configuration is defined by a condition of the valves in which each valve in the plurality of valves is in either the fully open position or the fully closed position.

In some examples, to identifying communicating zones of a first well in which a first tubing string is located which cause production of a production fluid in a second well in which a second tubing string is located, the injection fluid may be injected from the injection string located in the first well from one valve while other valves in the injection string remain closed. With all valves of the production string in the second well opened, the production flow in the production string in the second well is sensed to determine in which zones/valve production of the production fluid is caused, for example, a pressure of the production fluid may be sensed as described above. This process is repeated for each valve in the injection string. After each valve in the injection string located in the first well is analyzed in this manner, a mapping between valves/zones in the injection string and valves/zones in the production string can be generated indicating fluid communication paths from valves/zones in the injection string to a valves/zones in the offsetting production string. This process can be performed for each of multiple injection strings in the same formation as a production string when multiple well interaction is suspected. This allows the determination of a 1-1 fluid communication path between valves/zones in an injection string to a valves/zones in an offsetting production string. The process may also be performed by injecting in multiple injection strings at the same time and sensing the production flow in the production string in the second well. This allows the determination of n−1 fluid communication paths between valves/zones in n injection strings to a valves/zones in an offsetting production string, where n is the number of injection strings in which injection occurs. Conversely, 1-m fluid communication paths between valves/zones in an injection string to a valves/zones in m offsetting production strings may be determined, where m is the number of production strings in which production is sensed. Further, n-m fluid communication paths between valves/zones in n_injection strings to a valves/zones in m offsetting production strings may be determined.

In some examples, the method further comprises: alternating between injecting into the communication zones of the first well and performing cyclical injection and production on the non-communicating zones of the first well in accordance with the operating schedule.

In some examples, the method further comprises: determining when a non-communicating zone of the first well becomes a communicating zone; and determining a new operating schedule for operating the first and second tubing strings in response to a determination that a non-communicating zone of the first well has become a communicating zone.

Example Tubing String for Injection Well

Referring to FIG. 1, there is provided a hydrocarbon producing system 100 including an injection well 104 and a production well 106. The injection well 104 includes a wellbore 104A for injecting an injection fluid from the surface 102 and into the subterranean formation 101. The production well 106 includes a wellbore 106A for receiving hydrocarbon material that is displaced and driven by the injection fluid, and conducting the received hydrocarbon material to the surface. In some embodiments, the injection fluid is water or at least a substantial fraction of the injection fluid is water. In other embodiments, the injection fluid is a gas such as, for example, enriched field gas or carbon dioxide.

Each one of the wellbores 104A, 106A, independently, may be straight, curved, or branched and may have various wellbore sections. A wellbore section is an axial length of a wellbore. A wellbore section may be characterized as "vertical" or "horizontal" even though the actual axial orientation may vary from true vertical or true horizontal, and even though the axial path may tend to "corkscrew" or otherwise vary. The term "horizontal", when used to describe a wellbore section, refers to a horizontal or highly deviated wellbore section as understood in the art, such as, for example, a wellbore section having a longitudinal axis that is between 70 and 110 degrees from vertical.

Figure 2:
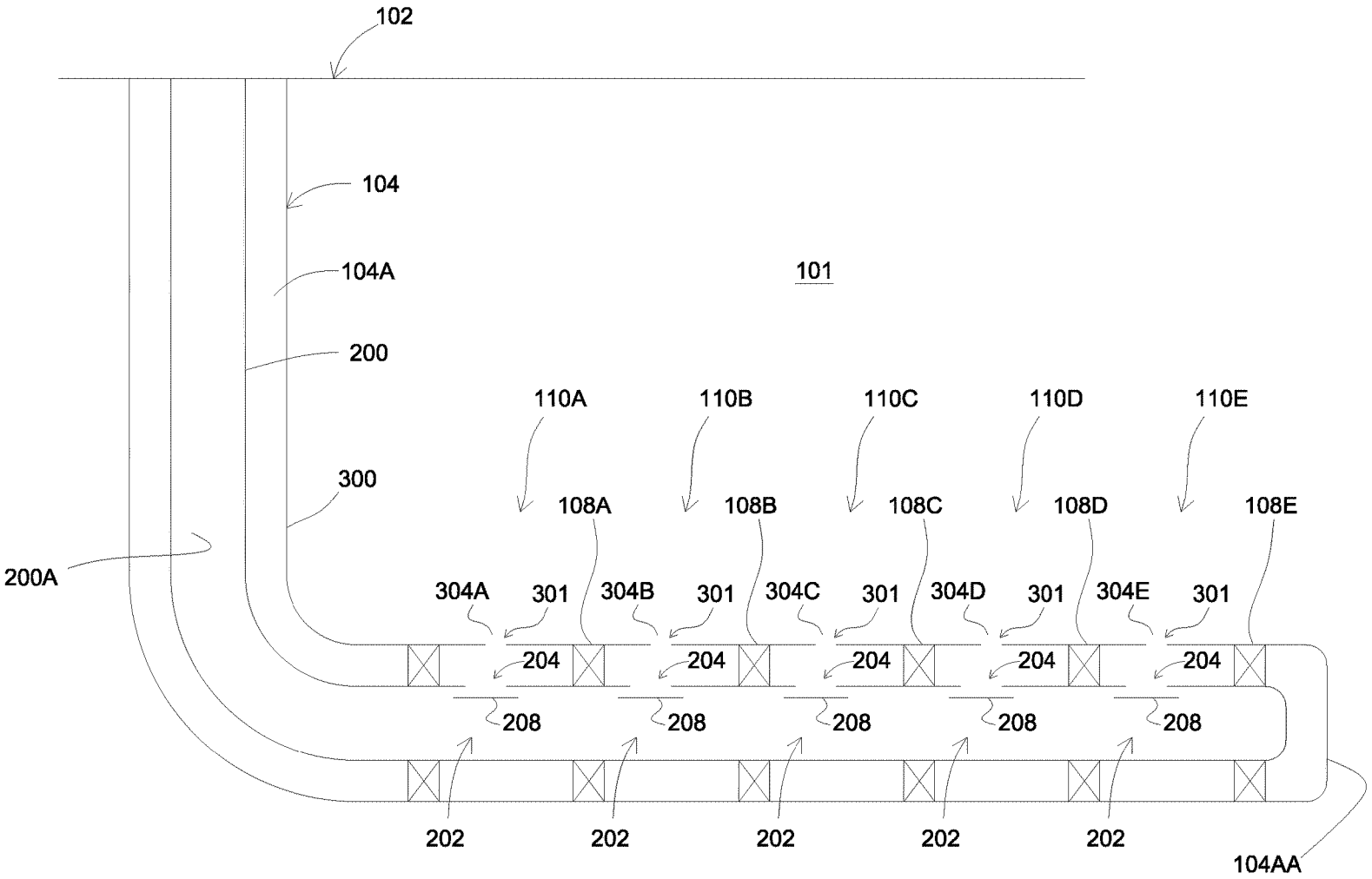
FIG. 2 is a schematic diagram of an injection string of the apparatus of FIG. 1 in accordance with an example embodiment of the present disclosure.

Referring to FIG. 2, the injection of the injection fluid from the surface 102 to the subterranean formation 101, via the injection well 104, is effected via one or more flow communication stations (five (5) flow communications 110A-E are illustrated). Successive flow communication stations may be spaced from each other along the wellbore such that each one of the flow communication stations 110A-E, independently, is positioned adjacent a zone or interval of the subterranean formation 101 for effecting flow communication between the wellbore 104A and the zone (or interval).

The injection fluid is injected through the wellbore 104A of the injection well 104 via an injection conduit 200, such as an injection string including an injection string passage 200A. The injection string 200 is disposed within the injection well 104. The injection fluid is injected from the injection string 200 into the wellbore 104A.

For effecting the flow communication between the injection string 200 and the wellbore 104A, at each one of the flow communication stations 110A-E, independently, the injection string 200 includes a respective flow control apparatus (valve) 202. The valve 202 includes a flow communicator 204 through which the injection of the injection fluid, into the wellbore, is effectible. The valve 202 is configured for integration within the injection string 200. The integration may be effected, for example, by way of threading or welding.

The valve 202 includes a flow control member 208. The flow control member 208 is configured for controlling the conducting of material by the valve 202 via the injection string flow communicator 204. The flow control member 208 is displaceable relative to the injection string flow communicator 204 for effecting opening of the injection string flow communicator 204. In some embodiments, for example, the flow control member 208 is also displaceable, relative to the injection string flow communicator 204, for effecting closing of the injection string flow communicator 204. In this respect, the flow control member 208 is displaceable from a closed position to an open position. The open position corresponds to an open condition of the injection string flow communicator 204. The closed position corresponds to a closed condition of the injection string flow communicator 204. For each one of the flow communication stations 110A-E, independently, an open condition of the flow communication station corresponds to the open condition of the respective injection string flow communicator 204. For each one of the flow communication stations 110A-E, independently, a closed condition of the flow communication station corresponds to the closed condition of the respective injection string flow communicator 204

In the closed position, the injection string flow communicator 204 is covered by the flow control member 208, and the displacement of the flow control member 208 to the open position effects at least a partial uncovering of the flow communicator 204 such that the flow communicator 204 becomes disposed in the open condition. In some embodiments, for example, in the closed position, the flow control member 208 is disposed, relative to the injection string flow communicator 204, such that a sealed interface is disposed between the injection string passage 200A and the wellbore 104A, and the disposition of the sealed interface is such that the conduction of the injection fluid between the injection string passage 200A and the wellbore 104A, via the injection string flow communicator 204 is prevented, or substantially prevented, and displacement of the flow control member 208 to the open position effects flow communication, via the injection string flow communicator 204, between the injection string passage 200A and the subterranean formation 101, such that the conducting of the injection fluid from the injection string passage 200A and the wellbore 104A, via the injection string flow communicator 204, is enabled.

In some embodiments, for example, the flow control member 208 is displaceable by a shifting tool. In some embodiments, for example, the flow control member is displaceable in response to receiving of an actuation signal (such as, for example, by actuation by a hydraulic pump).

In some embodiments, for example, the injection well 104 includes a cased-hole completion. In such embodiments, the wellbore 104A is lined with casing 300.

A cased-hole completion involves running casing 300 down into the wellbore 104A through the production zone. The casing 300 at least contributes to the stabilization of the subterranean formation 101 after the wellbore 104A has been completed, by at least contributing to the prevention of the collapse of the subterranean formation 101 that is defining the wellbore 101. In some embodiments, for example, the casing 300 includes one or more successively deployed concentric casing strings, each one of which is positioned within the wellbore 104A, having one end extending from the wellhead 12. In this respect, the casing strings are typically run back up to the surface. In some embodiments, for example, each casing string includes a plurality of jointed segments of pipe. The jointed segments of pipe typically have threaded connections.

In some embodiments, for example, it is desirable to seal an annulus, formed within the wellbore, between the casing string and the subterranean formation. Sealing of the annulus is desirable for mitigating versus conduction of the fluid, being injected into the subterranean formation, into remote zones of the subterranean formation and thereby providing greater assurance that the injected fluid is directed to the intended zone of the subterranean formation.

To prevent, or at least interfere, with conduction of the injected fluid through the annulus, and, perhaps, to an unintended zone of the subterranean formation that is desired to be isolated from the formation fluid, or, perhaps, to the surface, the annulus is filled with a zonal isolation material. In some embodiments, for example, the zonal isolation material includes cement, and, in such cases, during installation of the assembly within the wellbore, the casing string is cemented to the subterranean formation 101, and the resulting system is referred to as a cemented completion.

In some embodiments, for example, the zonal isolation material is disposed as a sheath within an annular region between the casing 300 and the subterranean formation 101. In some embodiments, for example, the zonal isolation material is bonded to both of the casing 300 and the subterranean formation 101. In some embodiments, for example, the zonal isolation material also provides one or more of the following functions: (a) strengthens and reinforces the structural integrity of the wellbore, (b) prevents, or substantially prevents, produced formation fluids of one zone from being diluted by water from other zones, (c) mitigates corrosion of the casing 300, and (d) at least contributes to the support of the casing 300.

In those embodiments where the injection well 104 includes a cased completion, in some of these embodiments, for example, the casing includes the plurality of casing flow communicators 304A-E, and for each one of the flow communication stations 110A-E, independently, the flow communication between the wellbore 104A and the subterranean formation 101, for effecting the injection of the injection fluid, is effected through the respective one of the casing flow communicators 304A-E. In some embodiments, for example, each one of the casing flow communicators 304A-E, independently, is defined by one or more openings 301. In some embodiments, for example, the openings are defined by one or more ports that are disposed within a sub that has been integrated within the casing string 300, and are pre-existing, in that the ports exist before the sub, along with the casing string 300, has been installed downhole within the wellbore 104A. Referring to FIG. 2, in some embodiments, for example, the openings are defined by perforations 301 within the casing string 300, and the perforations are created after the casing string 300 has been installed within the wellbore 104A, such as by a perforating gun. In some embodiments, for example, for each one of the flow communication stations 110A-E, independently, the respective one of the casing flow communicator 304A-E is disposed in alignment, or substantial alignment, with the injection string flow communicator 204 of the respective one of the flow communication stations 110A-E In this respect, in those embodiments where the injection well 104 includes a cased completion, in some of these embodiments, for example, for each one of the flow communication stations 110A-E, independently, flow communication, via the flow communication station, is effectible between the surface 102 and the subterranean formation 101 via the injection string 104, the respective injection string flow communicator 204, the annular space 104B within the wellbore 104A between the injection string 200 and the casing string 300, and the respective one of the casing string flow communicators 304A-E.

In some embodiments, for example, while injecting injection fluid into the subterranean formation 101 via a one of the flow communication stations 110A-E (the "stimulation-effecting flow communication station"), for each one of the adjacent flow communication stations, independently, a sealed interface is disposed within the wellbore 104A-E for preventing, or substantially preventing, flow communication, via the wellbore, between the stimulation-effecting flow communication station and the adjacent flow communication station. In this respect, with respect to the embodiment illustrated in FIG. 1, sealed interfaces 108A-D are provided. In some embodiments, for example, the sealed interface is established by a packer. In those embodiments where the completion is a cased completion, in some of these embodiments, for example, the sealed interface extends across the annular space between the injection string 200 and the casing string 300.

In some embodiments, for example, with respect to the flow communication station that is disposed furthest downhole (i.e. flow communication station 110E), a further sealed interface 108E is disposed within the wellbore 104A for preventing, or substantially preventing, flow communication between the flow communication station 110E and a downhole-disposed portion 104AA of the wellbore 104A.

Figure 3:
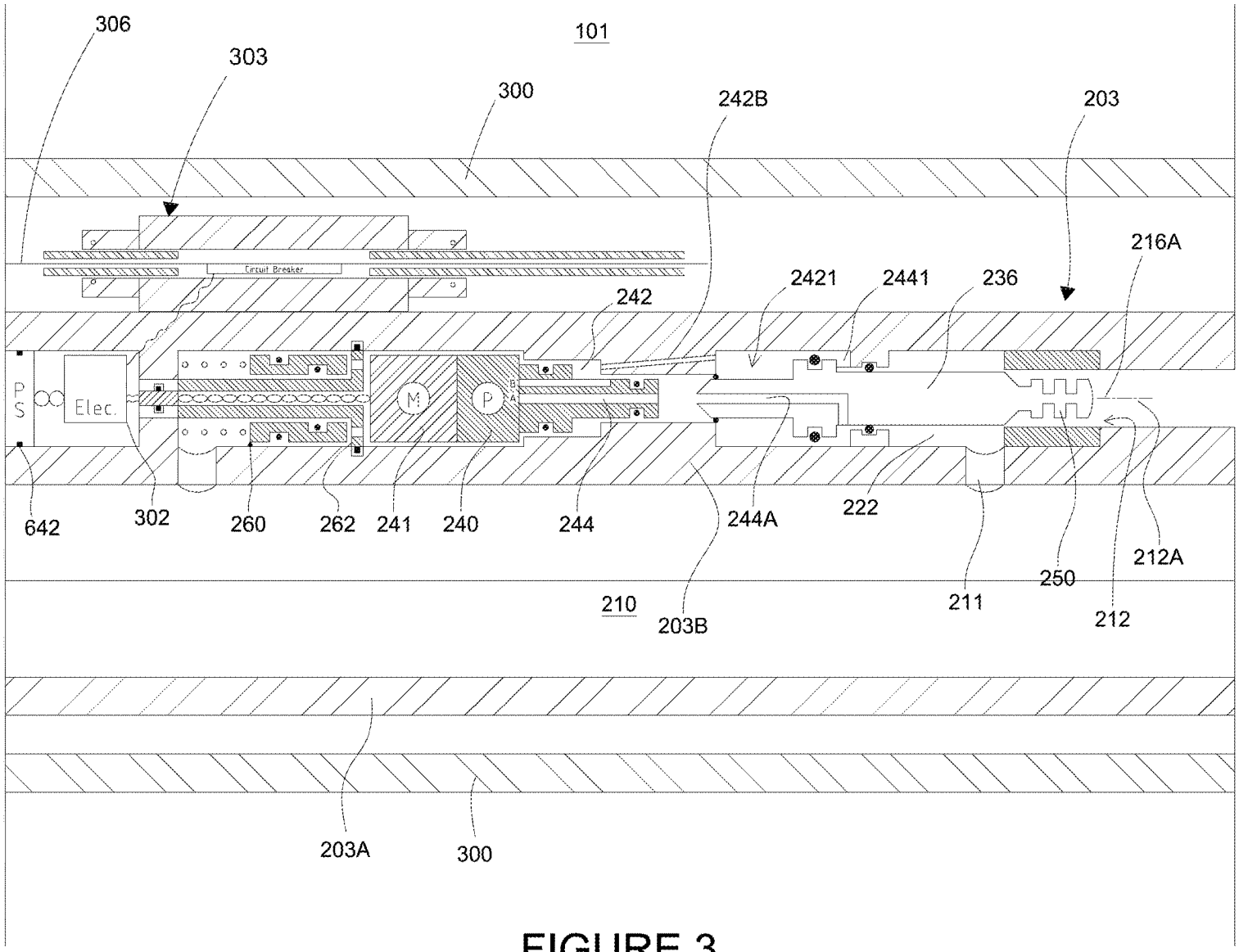
FIG. 3 is a schematic diagram of a valve for use in the injection string of FIG. 2 with the valve in a closed condition in accordance with an example embodiment of the present disclosure.

Referring to FIGS. 2 and 3, in some embodiments, for example, the valve 202 includes a housing 203. The housing 203 contains a fluid conductor 205 and a valve subassembly 230. The fluid conductor 205 includes a fluid passage housing 203A that defines a fluid passage 210 for effecting conduction of the injection fluid through the valve 202 while the valve 202 is integrated within the injection string 200. In this respect, the fluid passage 210 forms part of the injection string passage 200A.

The valve subassembly 230 is provided for controlling flow communication between the fluid passage 210 and the subterranean formation 101. In this respect, the valve subassembly 230 includes a valve subassembly housing 203B that contains the flow communicator 204 and the flow control member 208. The housing 203B is mounted to the housing 203A.

The flow communicator 204 effects flow communication between the fluid passage 210 and the subterranean formation 101. The flow communicator 204 includes one or more ports 212 defined within an outermost surface of the housing 203 (such as, for example, a manifold 214 of the housing 203B). In this respect, the flow communication between the fluid passage 210 and the subterranean formation 101 is effectible via the one or more ports 212. The injection string flow communicator 204 further includes an orifice 216 disposed within a space 222 (e.g. a passage) between the fluid passage 210 and the one or more ports 212, such that flow communication between the fluid passage 210 and the one or more ports 212 (and, therefore, the subterranean formation 101) is effectible via the orifice 216.

Figure 4:
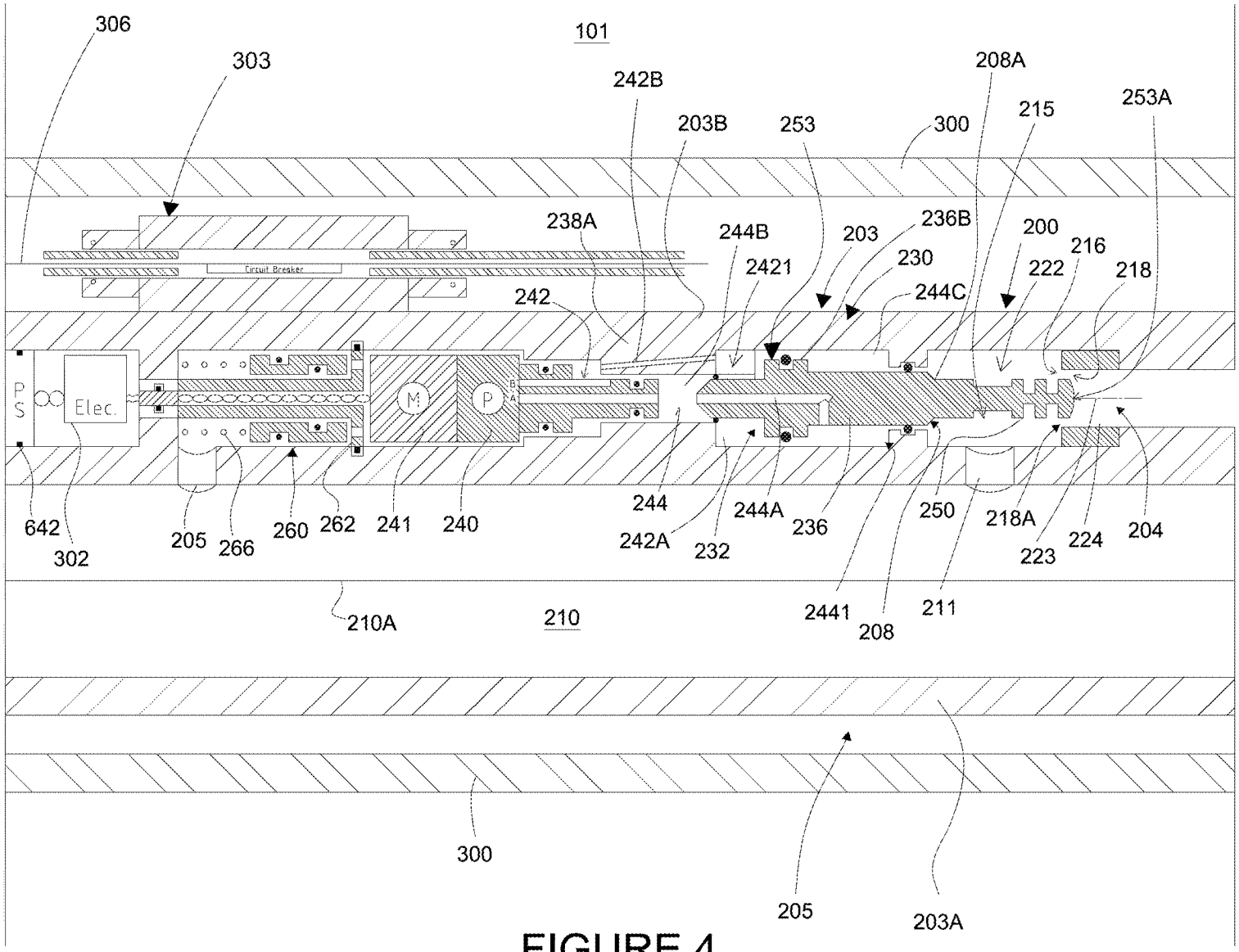
FIG. 4 is a schematic diagram of a valve for use in the injection string of FIG. 2 with the flow communicator in an open condition in accordance with an example embodiment of the present disclosure.

The orifice 216 is defined within a valve seat 218. In some embodiments, for example, the valve seat 218 is defined within a manifold of the housing 203B. The valve seat 218 is configured for receiving seating of the flow control member 208 (such that the flow control member 208 becomes disposed in the closed position) for effecting disposition of the injection string flow communicator 204 in the closed condition. Referring to FIG. 4, while the flow control member 208 is spaced apart from the valve seat 218, the flow control member 208 is disposed in the open position, and, correspondingly, flow communication is established between the fluid passage 210 and the one or more ports 212 via the orifice 216, such that the injection string flow communicator 204 is disposed in the open condition. In some embodiments, for example, the flow control member 208 includes a seat-engaging surface 208A for seating on a seating surface 218A defined by the valve seat 218 (FIG. 3), such that the flow communicator 204 becomes disposed in the closed condition. In some embodiments, for example, the material of the seat engaging surface 208A is nickel aluminum bronze and the material of the seating surface 218A is QPQ-nitrided 17-4PH stainless steel.

The orifice 216 has a central axis 216A, and the fluid passage 210 defines a central longitudinal axis 210A. In some embodiments, for example, the orifice 216 and the fluid passage 210 are co-operatively configured such that, while the valve 202 is oriented such that the central axis 216A is disposed within a horizontal plane, the central longitudinal axis 210A is disposed at an acute angle of less than 45 degrees relative to the horizontal plane, such as, for example, at an acute angle of less than 22.5 degrees relative to the horizontal plane, such as, for example at an acute angle of less than 10 degrees relative to the horizontal plane. In some embodiments, for example, the orifice 216 and the fluid passage 210 are co-operatively configured such that, while the valve 202 is oriented such that the central axis 216A is disposed within a horizontal plane, the central longitudinal axis 210A is parallel, or substantially parallel, to the horizontal plane.

In some embodiments, for example, the orifice 216 defines a central axis 216A, and each one of the one or more ports 212, independently, define a central axis 212A. In some embodiments, for example, the orifice 216 and the one or more ports 212 are co-operatively configured such that, while the valve 202 is oriented such that the central axis 216A is disposed within a horizontal plane, the central axis 212A is disposed at an acute angle of less than 45 degrees relative to the horizontal plane, such as, for example, at an acute angle of less than 22.5 degrees relative to the horizontal plane, such as, for example at an acute angle of greater than 10 degrees relative to the horizontal plane. In some embodiments, for example, the orifice 216 and the one or more ports 212 are co-operatively configured such that, while the valve 202 is oriented such that the central axis 216A is disposed within a horizontal plane, the central axis 212A is parallel to the horizontal plane.

In some embodiments, for example, a tracer material source 224 is disposed within the space 222. The tracer material source 224 is configured for releasing tracer material into injection fluid that is flowing past the tracer material source 224, while being injected into the subterranean formation 101 via the injection string flow communicator 204, for monitoring by a sensor within the system 100 to provide information about the process. By virtue of the above-described co-operative orientation of the fluid passage 210, the orifice 216, and the one or more of the ports 212, there is an opportunity to increase the volume of the space 222 disposed between the fluid passage 210 and the one or more ports 212 without impacting, or without at least significantly impacting, on the space available within the apparatus for defining the fluid passage 210. In this respect, the space 222 could be made larger for accommodating a larger quantity of tracer material.

In some embodiments, for example, the valve subassembly 230 further includes an actuator 232 for effecting displacement of the flow control member 208 relative to the valve seat 218. In some embodiments, for example, the flow control member 208 is mounted to the actuator 232.

In some embodiments, for example, the actuator 232 is a linear actuator, and is disposed for movement along a linear axis, such that the flow control member 208, correspondingly, is also disposed for movement along the linear axis. In some embodiments, for example, this axis of travel is parallel, or substantially parallel, to the central axis of the orifice 116 (and, in some embodiments, for example, the travel is along an axis that is co-incident, or substantially co-incident, with the central axis 216A of the orifice 116).

In some embodiments, for example, seating of the flow control member 208 relative to the valve seat 218 (FIG. 3) is effected by extension of the linear actuator 232 towards the valve seat 218 to an extended position, and unseating of the flow control member 208 relative to the valve seat 218 is effected by retraction of the linear actuator 232 relative to the valve seat 218 to a retracted position. In some embodiments, for example, the linear actuator 232 is configured to reciprocate between the extended (FIG. 3) and retracted positions (FIG. 4).

In some embodiments, for example, the linear actuator 232 is a hydraulic actuator that includes working fluid and a piston 236, with the working fluid being disposed in fluid pressure communication with the piston 236. In some embodiments, for example, the working fluid is a hydraulic oil. Relatedly, the valve sub-assembly housing 203B is configured for containing the working fluid. The housing 203B, the working fluid, and the piston 236 are co-operatively configured such that, in response to pressurizing of the working fluid, an unbalanced force is established and exerted on the piston 236 for urging movement of the piston 236, with effect that the flow control member 208 is displaced relative to the valve seat 218. In some embodiments, for example, the hydraulic actuator 232 has a first mode of operation and a second mode of operation, and, in the first mode of operation, the establishment of an unbalanced force is with effect that seating of the flow control member 208, relative to the valve seat 218, is effected (FIG. 3), and, in the second mode of operation, the establishment of an unbalanced force is with effect that unseating of the flow control member 208, relative to the valve seat 218, is effected (FIG. 4). In some embodiments, for example, the hydraulic actuator 232 further includes a bi-directional pump 240 which is operable in the first and second modes of operation in co-operation with a bi-directional motor 241 that is electrically coupled, via an eight (8) pin connector 302, to a power supply 303, extending externally, of the injection string 200, in the form of a power and communications cable 306, which may be a power-line providing both data and power-line communications (PLC) to a control unit of the valves 202. The PLC 606 may communicate with the control units of the valves 202 via half-duplex communication.

The valve 202 also comprises the pressure sensor 642 (FIG. 6) coupled to a PLC 606 (FIG. 6) at the surface 102 via the power and communications cable 306. Alternatively, the pressure sensor 642 may be coupled to the PLC 606 wirelessly via a wireless transmitter (not shown) of the valve 202. The pressure sensor 642 is located within the valve 202 for measuring a pressure of the formation when the valve 202 is in either the fully opened position or the fully closed position. The pressure sensor 642 may be located in an externally exposed portion of the valve 202 that is exposed to the formation into which the tubing string is located. The valves 202 of the tubing string allows the pressure of the formation at the location of each of the valves to be determined.

As noted above, for the telemetry system of the valves 202, a half-duplex system may be used in which only one control unit of a valve 202 can transmit at a time so that a surface modem controls which control unit is transmitting and when that control unit is transmitting. Each control unit has a unique address so that a relative position of the control unit in the well is known. In some examples, data modulation is performed by binary phase-shift keying (BPSK), a form of differential phase-shift keying (DPSK) with an option to be Quadrature phase-shift keying (QPSK) or 8-psk depending on data requirements. Pulse Width Modulation (PWM) outputs from a processor of the controller are output into a half bridge driver that drives a transformer (the coupling network) to shape and couple the data to the power-line. The half bridge driver is similar to a class D audio amplifier. The data communication may be a serial communications protocol such as Modbus or a derivation thereof.

In those embodiments where the hydraulic actuator 232 includes a bi-directional pump 240, in some of these embodiments, for example, a first working fluid-containing space 242 and a second working fluid-containing space 244 are disposed within the housing 203B. Each one of the spaces 242, 244, independently, is disposed in fluid pressure communication with the piston 236.

The housing 203B, the bidirectional pump 240, the first space 242, and the second space 244 are co-operatively configured such that, while the flow control member 208 is seated relative to the valve seat 218, and the bidirectional pump 240 becomes disposed in the first mode of operation, the bidirectional pump 240 is receiving supply of working fluid from the first space 242 and discharging pressurized working fluid into the second space 244, with effect that working fluid, within the second space 244, and in fluid pressure communication with the piston 236, becomes disposed at a higher pressure than working fluid within the first space 242 and in fluid pressure communication with the piston 236, such that an unbalanced force is acting on the piston 236 and effects retraction of the piston 236 relative to the valve seat 218, such that the flow control member 208 becomes unseated relative to the valve seat 218 and thereby effecting flow communication between the fluid passage 210 and the subterranean formation via the flow communicator 204.

The housing 203B, the bidirectional pump 240, the first space 242, and the second space 244 are further co-operatively configured such that, while the flow control member 208 is unseated relative to the valve seat 218, and the bidirectional pump 240 becomes disposed in the second mode of operation, the bidirectional pump 240 is receiving supply of working fluid from the second space 244 and discharging pressurized working fluid into the first space 242, with effect that working fluid, within the first space 242 and in fluid pressure communication with the piston 236, becomes disposed at a higher pressure than working fluid within the second space and in fluid pressure communication with the piston, such that an unbalanced force is acting on the piston 236 and effects extension of the piston 236 relative to the valve seat 218, such that the flow control member 208 becomes seated relative to the valve seat 218, with effect that the flow communicator 204 becomes disposed in the closed condition.

In some embodiments, for example, the first space 242 is disposed for fluid coupling with a working fluid supply compensator 260, in response to the pressure of the working fluid within the first space 242 becoming disposed below a minimum predetermined pressure. Similarly, in some embodiments, for example, the second space 244 is disposed for fluid coupling with a working fluid supply compensator 260, in response to the pressure of the working fluid within the second space 244 becoming disposed below a minimum predetermined pressure. This is to ensure that working fluid is being supplied from the discharge of the pump 240 at a sufficient pressure for acting on the piston 236 and overcoming the force applied by the injection fluid within the space 222 for resisting movement of the piston 236, and thereby effecting extension and retraction of the piston 236.

The working fluid supply compensator 260 includes working fluid disposed at a pressure of at least the pressure of the injection fluid disposed within the fluid passage 210. In this respect, the working fluid within the working fluid supply compensator 260 is disposed in fluid pressure communication with the injection fluid disposed within the fluid passage 210, such as via a moveable piston 262 that is sealingly disposed within the working fluid supply compensator 260. In some embodiments, for example, the pressure of the injection fluid disposed within the fluid passage 210 is between 0 psig and 10,000 psig.

The injection fluid is communicated from the fluid passage 210 via a port 205 disposed within the housing 203A, such that the working fluid within the working fluid supply compensator 260 is disposed at the same, or substantially the same, pressure as the injection fluid within the fluid passage 210. In some embodiments, for example, a resilient member, such as spring 266, is disposed within the compensator 260 and biases the piston 262 towards the working fluid for creating a pre-load on the working fluid, and this is useful during start-up to prevent cavitation. In this respect, the pressure of the working fluid is equivalent to about the sum of the pressure of the injection fluid within the fluid passage 210 and that attributable to the spring force.

Figure 5:
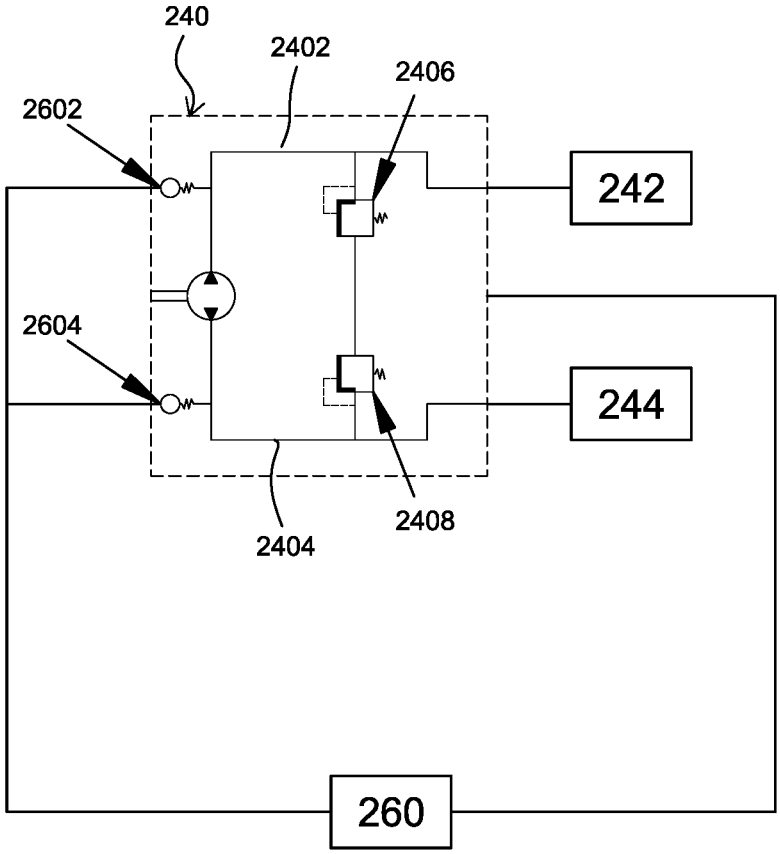
FIG. 5 is a schematic diagram of the valve of FIGS. 2 and 3 showing the flow communication between a bi-directional pump, first and second working fluid-containing spaces, and a working fluid supply compensator of the valve in accordance with an example embodiment of the present disclosure.

Referring to FIG. 5, a one-way valve 2602 (such as, for example, a check valve) is provided for controlling flow communication with the working fluid supply compensator 260, and is configured for opening in response to the pressure of the working fluid within the first space 242 becoming disposed below the pressure of the working fluid within the working fluid compensator 260. Similarly, a one-way valve 2604 (such as, for example, a check valve) is provided for controlling flow communication with the working fluid supply compensator 260, and is configured for opening in response to the pressure of the working fluid within the second space 244 becoming disposed below the pressure of the working fluid within the working fluid compensator 260.

Again referring to FIG. 5, the bi-directional hydraulic pump 240 includes a first fluid passage 2402 that is disposed in flow communication with the first space 242, and a second fluid passage 2404 that is disposed in flow communication with the second space 244. The first fluid passage 2402 is disposed in flow communication with a valve 2406 (such as, for example, a relief valve) configured for opening in response to the pressure differential between the first fluid passage 2402 and the working fluid supply compensator 260 becoming disposed above a predetermined maximum pressure differential (such as, for example, 5500 psig), with effect that working fluid from within the first space 242 is conducted to the working fluid supply communicator 260 for accumulation within the working fluid supply communicator 260. Similarly, the second fluid passage 2404 is disposed in flow communication with a valve 2408 (such as, for example, a relief valve) configured for opening in response to the pressure differential between the second fluid passage 2404 and the working fluid supply communicator 260 becoming disposed above a predetermined maximum pressure differential (such as, for example, 5500 psig), with effect that working fluid from within the second space 242 is conducted to the working fluid supply communicator 260 for accumulation within the working fluid supply communicator 260. By virtue of this configuration, fluid pressure within the first and second spaces 242, 244 may be sufficiently reduced for establishing the necessary force imbalance to effect actuation of the piston 236.

Referring again to FIGS. 2 and 3, in some embodiments, for example, a passage 244A extends through the piston 236 and joins two portions 244B, 244C of the space 244. In this respect, the piston 236, the space 244B, and the space 244C are co-operatively configured such that joinder of the spaces 244B, 244C is maintained while the piston 236 is displaced between the extended and retracted positions. By configuring the second space 244 in this manner, fluid communication between the space 242 and the hydraulic pump 240 is effected on the same side of the hydraulic pump 240 as is fluid communication between the space 244 and the hydraulic pump 240. In this respect, space within the housing 203, occupied by the first and second spaces 242, 244, is minimized, thereby enabling more of the space within the housing 203 to be dedicated for the fluid passage 210.

In some embodiments, for example, the space 244C is defined by a chamber 2441 that is disposed within the housing 203B, between an enlarged piston portion 236B of the piston 236 and the orifice 218. Relatedly, a portion 242A of the first space 242 is defined by a chamber 2421 that is disposed within the housing 203B and is also disposed, relative to the chamber 2441, on an opposite side of the enlarged piston portion 236B, between the enlarged piston portion 236B and a union 238A. Working fluid within chamber 2441 is urging displacement of the enlarged piston portion 236B remotely relative to the orifice 216, and thereby urging the flow control member 108 towards an unseated position. Working fluid within chamber 2421 is urging displacement of the enlarged piston portion 236B towards the orifice 216, and thereby urging the flow control member 108 towards a seated position.

Displacement of the enlarged piston portion 236B, remotely relative to the orifice 216, is limited by the union 238A, which, in this respect, functions as a piston retraction-limiting stop. Relatedly, displacement of the enlarged piston portion 236B, towards the orifice, is limited by the valve seat 218. In some embodiments, for example, while being displaced during the retraction and extension of the piston 236, the enlarged piston portion 236B is sealingly disposed within the housing 203B, thereby preventing, or substantially preventing, conduction of working fluid between the chambers 2421 and 2441 via space between the housing 203B and the enlarged piston portion 236B.

The union 238A forms part of the housing 203B. The union 238A is disposed between the hydraulic pump 240 and the chamber 2421 (and, therefore, also the chamber 2441). In some embodiments, for example, the hydraulic pump 240 is threadably coupled to the union 238A.

A passage 242B extends through the union 238A such that the space 242 extends from the space 242A defined by the chamber 2421 to the hydraulic pump 240, via the passage 242B.

In some embodiments, for example, a cutting tool 250 is mounted to the piston 236 for translation with the flow control member 208 while the flow control member 208 is being displaced between the seated and the unseated positions. The flow control member 208 and the cutting tool 250 are co-operatively configured such that, while the flow control member 208 is seated relative to the valve seat 218, the cutting tool 250 extends into a space 223 disposed between the orifice 216 and the one or more ports 212. In some embodiments, for example, the flow control member 208 and the cutting tool 250 are also co-operatively configured such that, while the flow control member 208 is unseated relative to the valve seat 218, at least a portion of the cutting tool 250 is retracted from the space 223.

In some embodiments, for example, the flow control member 208, the valve seat 218, the orifice, the space 223 extending from the orifice 216 to the one or more ports, and the cutting tool are co-operatively configured such that, while the flow control member 208 is unseated relative to the valve seat 218, and the cutting tool 250 is disposed within the space 223 (e.g. a passage), the cutting tool 250 occupies less than about 70% of the cross-sectional area of the space 223, such as, for example, less than about 60% of cross-sectional area of the space 223.

The flow control member 208 and the cutting tool 250 are further co-operatively configured such that, while: (i) the flow control member 208 is being displaced relative to the valve seat 218 between the seated and the unseated positions, and (ii) solid debris is disposed within the space 223 (such as, for example, by way of ingress from the subterranean formation 101 via the one or more ports 202, or, such as, for example, by way of precipitation from the injection fluid, or both), the cutting tool 250 effects size reduction of the solid debris (such as, for example, by way of comminution, such as, for example, by way of crushing, grinding, or cutting), such that size-reduced solid debris is obtained. By effecting such size reduction, obstruction of flow communication between the fluid passage 210 and the injection string flow communicator 204 is mitigated. As well, by effecting such size reduction, obstruction of mechanical components of the valve apparatus 202, by such solid debris, is mitigated.

In some embodiments, for example, the flow control member 208 and the cutting tool 250 are further co-operatively configured such that, while the flow control member 208 is being retracted relative to the valve seat 218 (i.e. from the seated position), the size-reduced solid debris is urged into the fluid passage 210 via a port 211, that is fluidly coupled to the orifice 216 with a fluid passage 215, defined within the housing 203B, such that the port 211 effects flow communication between the fluid passage 210 and the orifice 216. In some embodiments, for example, the urging is effected by the cutting tool 250 as the piston 236 is being retracted. In this respect, in some embodiments, for example, the flow control member 208, the cutting tool 250 and the port 211 are co-operatively configured such that, while the flow control member 208 is being retracted relative to the valve seat 218 (i.e. from the seated position), the port 211 is disposed to receive the size-reduced solid debris being urged from the space 223 by the cutting tool 250 (for conduction into the fluid passage 210) that is translating with the flow control member 208.

In some embodiments, for example, the cutting tool 250 include a plurality of cutting blades 252 extending outwardly from an outer surface. In some embodiments, the distance by which the blades 252 extend outwardly from the outer surface is at least 30/1000 of an inch. In some embodiments, for example, the cutting tool 250 includes grooves disposed between the cutting blades 252. In some embodiments, for example, a set of the cutting blades is arranged along a spiral path. In some embodiments, for example, the cutting tool 250 includes a reamer.

In some embodiments, for example, a reciprocating assembly 253 includes at least the piston 236 and the flow control member 208, and, in some embodiments, further includes the cutting tool 250. While the flow control member 208 is seated relative to the valve seat 218, a distal end 253A, of the reciprocating assembly 253, extends through the orifice 216 and into the space 223, while being spaced apart from the housing 203B. While spaced apart from the housing 203, the distal end 253A is susceptible to deflection from the weight of solid debris which may have accumulated within the space 223. To mitigate versus undesirable deflection, while the flow control member 208 is seated relative to the valve seat 218, the maximum spacing distance, between the distal end 253A and the housing 203B is less than 30/1000 of an inch. In some embodiments, for example, while the flow control member 208 is seated relative to the valve seat 218, the distal end 253A is disposed within the space 223 (e.g. a passage) that is extending from the orifice 216 to the one or more ports 212.

Although the valve 202 has been described above as being configured for integration within an injection string, the valve 202 may be configured for integration within a production string and used within a production string, which may be in a different well as an offsetting injection string or the same well as an injection string, each of the injection strings and/or production strings comprising a number of valves 202.

General

The steps and/or operations in the flowcharts and drawings described herein are for purposes of example only. There may be many variations to these steps and/or operations without departing from the teachings of the present disclosure. For instance, the steps may be performed in a differing order, or steps may be added, deleted, or modified.

The coding of software for carrying out the above-described methods described is within the scope of a person of ordinary skill in the art having regard to the present disclosure. Machine-readable code executable by one or more processors of one or more respective devices to perform the above-described method may be stored in a machine-readable medium such as the memory of the data manager. The terms "software" and "firmware" are interchangeable within the present disclosure and comprise any computer program stored in memory for execution by a processor, comprising Random Access Memory (RAM) memory, Read Only Memory (ROM) memory, EPROM memory, electrically EPROM (EEPROM) memory, and non-volatile RAM (NVRAM) memory. The above memory types are examples only, and are thus not limiting as to the types of memory usable for storage of a computer program.

All values and sub-ranges within disclosed ranges are also disclosed. Also, although the systems, devices and processes disclosed and shown herein may comprise a specific plurality of elements, the systems, devices and assemblies may be modified to comprise additional or fewer of such elements. Although several example embodiments are described herein, modifications, adaptations, and other implementations are possible. For example, substitutions, additions, or modifications may be made to the elements illustrated in the drawings, and the example methods described herein may be modified by substituting, reordering, or adding steps to the disclosed methods.

Features from one or more of the above-described embodiments may be selected to create alternate embodiments comprised of a subcombination of features which may not be explicitly described above. In addition, features from one or more of the above-described embodiments may be selected and combined to create alternate embodiments comprised of a combination of features which may not be explicitly described above. Features suitable for such combinations and subcombinations would be readily apparent to persons skilled in the art upon review of the present application as a whole.

In addition, numerous specific details are set forth to provide a thorough understanding of the example embodiments described herein. It will, however, be understood by those of ordinary skill in the art that the example embodiments described herein may be practiced without these specific details. Furthermore, well-known methods, procedures, and elements have not been described in detail so as not to obscure the example embodiments described herein. The subject matter described herein and in the recited claims intends to cover and embrace all suitable changes in technology.

Although the present disclosure is described at least in part in terms of methods, a person of ordinary skill in the art will understand that the present disclosure is also directed to the various elements for performing at least some of the aspects and features of the described methods, be it by way of hardware, software or a combination thereof. Accordingly, the technical solution of the present disclosure may be embodied in a non-volatile or non-transitory machine-readable medium (e.g., optical disk, flash memory, etc.) having stored thereon executable instructions tangibly stored thereon that enable a processing device to execute examples of the methods disclosed herein.

The term "processor" may comprise any programmable system comprising systems using microprocessors/controllers or nanoprocessors/controllers, digital signal processors (DSPs), application specific integrated circuits (ASICs), field-programmable gate arrays (FPGAs) reduced instruction set circuits (RISCs), logic circuits, and any other circuit or processor capable of executing the functions described herein. The term "database" may refer to either a body of data, a relational database management system (RDBMS), or to both. As used herein, a database may comprise any collection of data comprising hierarchical databases, relational databases, flat file databases, object-relational databases, object oriented databases, and any other structured collection of records or data that is stored in a computer system. The above examples are example only, and thus are not intended to limit in any way the definition and/or meaning of the terms "processor" or "database".

The present disclosure may be embodied in other specific forms without departing from the subject matter of the claims. The described example embodiments are to be considered in all respects as being only illustrative and not restrictive. The present disclosure intends to cover and embrace all suitable changes in technology. The scope of the present disclosure is, therefore, described by the appended claims rather than by the foregoing description. The scope of the claims should not be limited by the embodiments set forth in the examples, but should be given the broadest interpretation consistent with the description as a whole.

What is claimed is:

1. A method of optimizing operation of one or more tubing strings, each tubing string being located in a hydrocarbon well and having a plurality of valves therein, each valve being actuatable between a fully open position and a fully closed position, each valve being in communication with a respective zone of a formation defining a reservoir containing hydrocarbon material, the method comprising:

for each injection string in the one or more tubing strings:

(i) supplying an injection fluid through the injection string and characterizing an injectivity of one or more zones of the formation in accordance with sensed characteristics of the injection fluid; and (ii) determining an optimal operating schedule for the injection string in accordance with the characterization of the one or more zones of the formation and one or more performance objectives of the injection string, wherein the optimal operating schedule comprises one or more valve configurations and an operating duration for each of the one or more valve configurations, wherein each valve configuration is defined by a condition of the valves in which each valve in the plurality of valves is in either the fully open position or the fully closed position.

2. The method of claim 1, further comprising:

(iii) opening, closing, or opening and closing the valves to cause a condition of the valves to be set in accordance with the optimal operating schedule for the injection string.

3. The method of claim 2, further comprising:

(iv) injecting the injection fluid into the injection string in accordance with the optimal operating schedule for the injection string;

(v) monitoring to detect one or more triggers for re-optimizing the optimal operating schedule for the injection string; and (vi) repeating steps (i) to (iii) in response to detection of at least one of the one or more triggers for re-optimizing the optimal operating schedule for the injection string.

4. The method of claim 1, wherein the method is at least partially performed by a remote server in communication with a controller, wherein the controller is coupled to the valves and controls a valve condition of each of the valves, wherein characterizing the injectivity and determining the optimal operating schedule is performed by the server and causing the condition of the valves to be set in accordance with the optimal operating schedule is performed by the controller, and wherein the causing the condition of the valves to be set in accordance with the optimal operating schedule comprises sending an instruction to the controller to open and/or close the valves to set the condition of the valves in accordance with the optimal operating schedule.

5. The method of claim 1, wherein the one or more performance objectives comprise one or more of evenly distributing the flow of the injection fluid through one or more valves in the plurality of valves, maximizing the flow of the injection fluid through one or more valves in the plurality of valves, maximizing an accumulated volume of injection fluid injected through one or more valves, maintaining a pressure of the injection fluid at surface at a desired value, minimizing changes in valve condition, isolating the flow of the injection fluid through one or more valves, distributing the flow of the injection fluid through one or more valves by predetermined differing amounts, and/or receiving the injection fluid through one or more valves in response to back pressure or under pressure from a surface pump.

6. The method of claim 1, wherein characterizing the injectivity of one or more zones of the formation comprises:

for each of a set of valve configurations:

opening, closing, or opening and closing the valves to cause a condition of the valves to be set in accordance with the valve configuration;

supplying the injection fluid to the formation through the injection string;

sensing one or more characteristics of the injection fluid at a location of one or more valves corresponding to the one or more zones of the formation to be characterized;

supplying the injection fluid to the formation through the injection string to be suspended;

continuing to sense the one or more characteristics of the injection fluid after suspending the supply of injection fluid to the formation until a termination condition is detected; and characterizing the one or more zones of the formation in accordance with changes in the sensed one or more characteristics of the injection fluid over time.

7. The method of claim 6, wherein the characterizing is based on an accumulated volume of the injection fluid determined from the one or more sensed characteristics of the injection fluid.

8. The method of claim 6, wherein while characterizing the injectivity of the one or more zones of the formation only one valve is open at a time, wherein when one valve is open the other valves in the plurality of valves are closed.

9. The method of claim 6, wherein characterizing the injectivity of the one or more zones of the formation is performed after the one or more zones of the formation are substantially charged with injection fluid.

10. The method of claim 6, wherein characterizing the injectivity of one or more zones of the formation comprises:

calculating a flow coefficient for each of the one or more zones of the formation in accordance with changes in a pressure or a flow rate of the injection fluid associated with the respective zone of the formation after suspending the supply of injection fluid to the formation through the injection string.

11. The method of claim 10, wherein determining the optimal operating schedule comprises:

calculating the flow rate for each of the one or more zones of the formation using the flow coefficient.

12. The method of claim 1, wherein characterizing the injectivity of one or more zones of the formation comprises:

for each valve in the injection string:

opening the valve while other valves in the injection string are kept closed;

supplying the injection fluid to the formation through the valve;

sensing a pressure of the injection fluid;

supplying the injection fluid to the formation through the injection string to be suspended;

continuing to sense the pressure of the injection fluid after suspending the supply of injection fluid to the formation through the injection string until a termination condition is detected; and characterizing a zone of the formation in communication with the valve in accordance with changes in the sensed pressure of the injection fluid over time.

13. The method of claim 1, wherein the method is performed for multiple tubing strings located in the formation, wherein each tubing string interacts with a common hydrocarbon reservoir well, wherein the method is performed for multiple tubing strings to jointly optimize the operation of the multiple tubing strings.

14. The method of claim 1, further comprising:

for each production string in the one or more tubing strings:

(iii) characterizing a production flow of one or more zones of the formation in accordance with sensed characteristics of a production fluid; and (v) determining an optimal operating schedule for the production string in accordance with the characterization of the production flow and/or one or more zones of the formation and one or more performance objectives of the production string.

15. The method of claim 14, further comprising:

for each production string in the one or more tubing strings:

(v) opening, closing, or opening and closing the valves to cause a condition of the valves of the production string to be set in accordance with the optimal operating schedule for the production string.

16. The method of claim 14, wherein the method is performed for multiple tubing strings located in the formation, wherein each tubing string interacts with a common hydrocarbon reservoir well, wherein the method is performed for multiple tubing strings to jointly optimize the operation of the multiple tubing strings.

17. The method of claim 14, further comprising:

(v) producing a production fluid from the formation through the production string in accordance with the optimal operating schedule for the production string;

(vi) monitoring the production fluid to detect one or more triggers for re-optimizing with the optimal operating schedule for the production string; and (vii) repeating steps (i) to (iii) in response to detection of at least one of the one or more triggers for re-optimizing with the optimal operating schedule for the production string.

18. The method of claim 14, wherein characterizing the production flow of one or more zones of the formation comprises:

for each of a set of valve configurations:

opening, closing, or opening and closing the valves to cause a condition of the valves to be set in accordance with the valve configuration;

producing the production fluid from the production string;

sensing one or more characteristics of the production fluid;

producing the production fluid from the production string to be suspended;

continuing to sense the one or more characteristics of the production fluid after suspending the production of the production fluid from the valve until a termination condition is detected; and characterizing the one or more zones of the formation in accordance with changes in the sensed one or more characteristics of the production fluid over time.

19. The method of claim 14, wherein the injection string and production string are located in the same well, wherein the injection string and production string are alternatively operated to provide cyclical injection and production from the same well.

20. The method of claim 14, wherein the injection string and production string are located in different wells within proximity of each other, which the injection of the injection fluid into the injection string stimulates production in the production string.

21. A method, performed by a processor of at least one apparatus, of optimizing operation of one or more tubing strings, each tubing string being located in a hydrocarbon well and having a plurality of valves therein, each valve being actuatable between a fully open position and a fully closed position, each valve being in communication with a respective zone of a formation defining a reservoir containing hydrocarbon material, the method comprising:

for each production string in the one or more tubing strings:

(i) supplying an injection fluid through the production string and characterizing a production flow of one or more zones of the formation in accordance with sensed characteristics of the production fluid; and (ii) determining an optimal operating schedule for the production string in accordance with the characterization of the production flow and/or one or more zones of the formation and one or more performance objectives, wherein the optimal operating schedule comprises one or more valve configurations and an operating duration for each of the one or more valve configurations, wherein each valve configuration is defined by a condition of the valves in which each valve in the plurality of valves is in either the fully open position or the fully closed position.

22. An apparatus, comprising:

at least one processor; and a memory coupled to the at least one processor, the memory having tangibly stored thereon executable instructions that, when executed by the at least one processor, cause the apparatus to perform the method of claim 1.

23. A non-transitory machine readable medium having tangibly stored thereon executable instructions for execution by at least one processor of an apparatus, wherein the executable instructions, when executed by the at least one processor, cause the processor to perform the method of claim 1.

* * * * *